US006985346B2

(12) United States Patent
Kraz et al.

(10) Patent No.: US 6,985,346 B2
(45) Date of Patent: Jan. 10, 2006

(54) METHOD AND DEVICE FOR CONTROLLING IONIZATION

(75) Inventors: Vladimir Kraz, Santa Cruz, CA (US); Kirk Alan Martin, Aptos, CA (US)

(73) Assignee: Credence Technologies, Inc., Soquel, CA (US)

( * ) Notice: Subject to any disclaimer, the term of this patent is extended or adjusted under 35 U.S.C. 154(b) by 257 days.

(21) Appl. No.: 10/434,831

(22) Filed: May 8, 2003

(65) Prior Publication Data

US 2004/0145852 A1 Jul. 29, 2004

Related U.S. Application Data

(60) Provisional application No. 60/443,602, filed on Jan. 29, 2003, provisional application No. 60/460,288, filed on Apr. 3, 2003.

(51) Int. Cl.
*H01T 23/00* (2006.01)

(52) U.S. Cl. ..... 361/230

(58) Field of Classification Search ..... 361/212, 361/213, 235, 225, 226, 230
See application file for complete search history.

(56) References Cited

U.S. PATENT DOCUMENTS

| | | | | |
|---|---|---|---|---|
| 4,097,851 | A * | 6/1978 | Klein | 340/628 |
| 5,294,794 | A * | 3/1994 | Davies | 250/287 |
| 6,826,030 | B2 * | 11/2004 | Gorczyca et al. | 361/212 |
| 6,850,403 | B1 * | 2/2005 | Gefter et al. | 361/230 |

* cited by examiner

*Primary Examiner*—Stephen W. Jackson
*Assistant Examiner*—Boris Benenson
(74) *Attorney, Agent, or Firm*—DLA Piper Rudnick Gray Cary US LLP

(57) ABSTRACT

A device and method for ionization control is provided. The device and method controls the ionization balance using a sensor element, a control circuit that produces output signal as a function of an input signal from the sensor and transmits that output signal to the ionizer being controlled. The device also has a mechanism for detecting rapid changes in the input signal and a mechanism for disabling changes in the control signal for the duration of presence of said rapidly-changing signal.

32 Claims, 25 Drawing Sheets

Static Voltage

A
B
C
D
E
F
Sensor output
Time
Prior Art
Sensor
Input resistance
Capacitive coupling with sensor
Charged object
Input capacitance
Equivalent Schematic
Resistive path for ion current
Ionizer
Out-of-Balance Ionization
66
68
70

Definition of direction and speed of control

Definition of ignoring static voltage

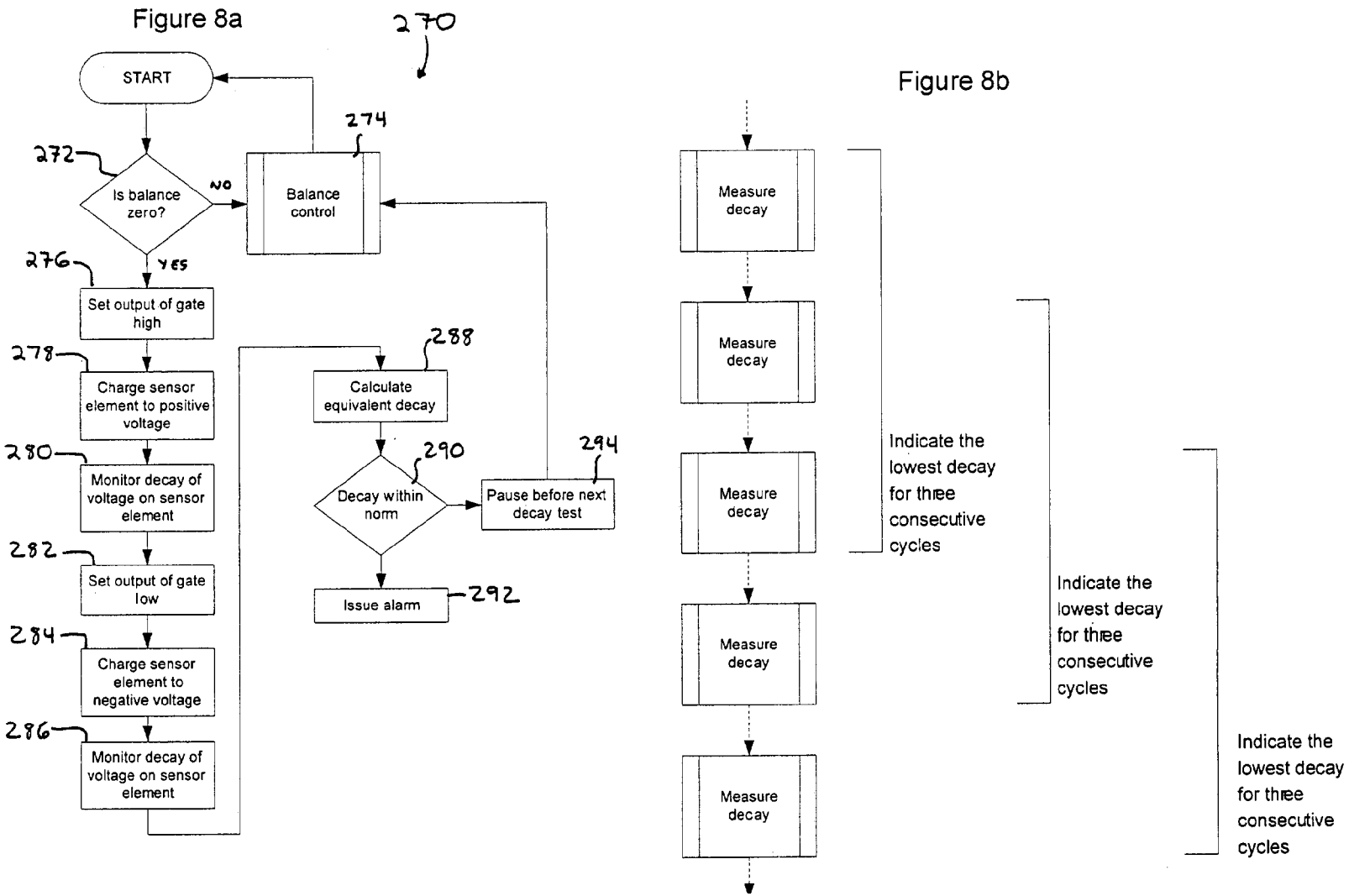
Figure 8a
270
START
Is balance zero?
272
NO
YES
Balance control
274
Set output of gate high
276
Charge sensor element to positive voltage
278
Monitor decay of voltage on sensor element
280
Set output of gate low
282
Charge sensor element to negative voltage
284
Monitor decay of voltage on sensor element
286
Calculate equivalent decay
288
Decay within norm
290
Issue alarm
292
Pause before next decay test
294
Figure 8b
Measure decay
Measure decay
Measure decay
Measure decay
Measure decay
Indicate the lowest decay for three consecutive cycles
Indicate the lowest decay for three consecutive cycles
Indicate the lowest decay for three consecutive cycles

METHOD AND DEVICE FOR CONTROLLING IONIZATION

RELATED APPLICATIONS

This application claims priority under 35 USC § 119 from 1) U.S. Provisional Application Ser. No. 60/443,602, filed on Jan. 29, 2003 and entitled "Method and Device for Managing Ionization" and 2) U.S. Provisional Application Ser. No. 60/460,288, filed on Apr. 3, 2003 and entitled "Method and Device for Controlling Ionization", both of which are incorporated herein by reference in their entirety.

FIELD OF THE INVENTION

This invention relates generally to a method and device for controlling ionization in a sensitive electronic environment.

BACKGROUND OF THE INVENTION

Ionization is one of the key components in controlling an electrostatic environment. Typical electronic components are manufactured using a plurality of processes. With the increasing sensitivity of electronic components (due to the smaller and smaller sizes of the features in those electronic components), the process' performance with respect to controlling ionization is under increased scrutiny to improve and to control their performance. An improperly functioning ionizer may actually charge sensitive components instead of discharging them. At best, poorly-functioning ionizers offer a false sense of security which is not acceptable in volume production of static-sensitive components, such as semiconductors, disk drive magnetic head, flat panel displays, etc.

Several methods exist currently that offer limited control over ionization. One method involves periodic tests using a charge plate monitor. This method does measure the ionization during the test, but does not offer any assurance of proper ionization in between the tests. In addition, such tests are often performed in the places where sensitive components are not handled so that the test is not measuring ionization at the appropriate place in the processes. These periodic tests are also time-consuming and require dedicated trained personnel to perform the tests. Another method involves built-in ionizer feedback controls. An example of such a control is a metal grill placed in front of an ionizer blower, such as Ion Systems' 5810 and Simco Centurion models. The grill functions as a sensor of ionizer balance and, using an internal control circuit of an ionizer, can automatically adjust balance within certain limits. The problem with this approach is that it offers only limited benefits. There is no guarantee that the balance in the immediate proximity to the ionization tips is the same as the balance away from the ionizer at the target of ionization. For example, the humidity of the air may significantly offset the resulting balance of ionization at the benchtop while it may be acceptable in the immediate proximity to the ionizer at the location of the grill. Zero balance may also mean that the decay function of an ionizer is not working.

Another prior system uses remote sensors with feedback to the ionizer to control the balance. Examples of the prior system include the EM Aware monitor CTC034-031-F by Credence Technologies and 5315 monitor by Novx. These monitors are capable of adjusting the balance of specially-equipped ionizers (such as Ion Systems' 5810 and Simco'Centurion models) according to the actual balance at the point of measurement. There are several deficiencies of this method. First, there is an inherent delay between the application of a control signal and the change of voltage at the point of control due mostly, but not exclusively, to the airflow from the ionizer to the workplace. Such delay makes tight control over balance nearly impossible. Aggravating the situation is that charged objects that may approach the sensor in normal production environment create a similar signal as from an imbalanced ionizer which causes the controller to send the ionizer a false correction signal that may cause severe imbalance charging at the target area to voltages as high as 100V or more. To alleviate this situation, manufacturers introduce delay and integration into the control circuit, however this makes real-time control of ionization balance impossible. Although sensors that offer monitoring of decay of ionization exist (such as above-mentioned EM Aware ESD monitor), no device and system currently exists to correct the performance of an ionizer based on decay performance information at the target point. In addition, there is no method that exists to control ionization from pulsed ionizers, such as Ion Systems' 5285 and others.

Thus, it is desirable to provide a method and device for controlling ionization that corrects these and other deficiencies with typical system and offers complete control over ionization parameters and it is to this end that the present invention is directed.

SUMMARY OF THE INVENTION

A device and method for controlling ionization balance is described. In one embodiment, the device may include a sensor element and a control circuit that produces an output signal as a function of input signal to the sensor. The output signal may be provided to an ionizer under control. The device also have a mechanism for detecting rapid changes in the input signal so that the changes to the control signal are disabled for the duration of presence of said rapidly-changing signal. The device may include an added current path from the sensor element to ground. The device may also change the speed of balance adjustment as the ionization balance approaches the desired level. The device may also include a dead band zone in which no adjustment to ionizer balance is made when ionizer balance is within determined acceptance range. The device also is capable of switching into a learning mode and is capable of learning the reaction of ionizer and adjusting its control parameters based on the reaction of the ionizer. The device may also have an indication mechanism of the balance and an alarm mechanism that indicates if the balance of outside of acceptable limits. The device also may switch into an observation mode for manual adjustment of balance of ionizer.

In accordance with another embodiment of the invention, the device may include a sensor element any may charge the sensor element that provides a voltage to the sensor element. The device then measures the voltage of the sensor element, calculates the voltage decay on the sensor element and indicates the results of the decay measurement. The device may further convert the measurement information into a value that is compatible with other devices such as standard charge plate monitor. The device also may measure its self-decay during calibration and then subtract the self-decay value from the actual decay measurements thus providing measurements of only the externally-caused decay. The sensor element may be located in the ionizer at the exit of ions. The device at the exit of the ions may also be used in conjunction with another device that is located at the place where decay needs to be controlled (i.e. workbench). The devices may have separate sensor elements to measure the ion balance and the ion decay. The device also may determine several consecutive decay measurements and then the "best" (or lowest decay) value is chosen in order to prevent false alarm in decay indication. The device may also include an airflow sensor that indicates proper airflow. The device may further include a feedback signal to the ionizer to control high voltage in order to keep decay within acceptable limits. The device may further include a mechanism for providing a feedback signal to the ionizer in order to control speed of fan in order to keep decay within acceptable limits. The device may further include both the high voltage feedback signal and the speed of fan feedback signal.

The sensor elements of the device may be implemented as top cover of the sensor enclosure or may be remotely located. In addition, the sensor elements may be connected in a chain on one cable to control multiple ionizer elements with the purpose to reduce cabling wherein a specific sensor is correlated to a specific ionizer controller. The communications between the sensor elements and the ionizer may be wireless or wired. The sensor elements may be powered by a photovoltaic device or have an energy storage device, such as a battery or capacitor, that stores the power necessary for communications.

The device in accordance with the invention may have a ground reference that is provided by electrical contact between bottom of enclosure and conductive surface. The device may be powered by an internal battery. The device in accordance with the invention may be used with typical ionizers as well as pulsed ionizers.

BRIEF DESCRIPTION OF THE DRAWINGS

FIGS. 8*a* and 8*b* are a flowchart illustrating a decay test method in accordance with the invention;

DETAILED DESCRIPTION OF A PREFERRED EMBODIMENT

The invention is particularly applicable to a ionization control device and method in a semiconductor process and it is in this context that the invention will be described. It will be appreciated, however, that the device and method in accordance with the invention has greater utility, such as to any process in which it is desirable to control the ionization of the process.

Figure 1:
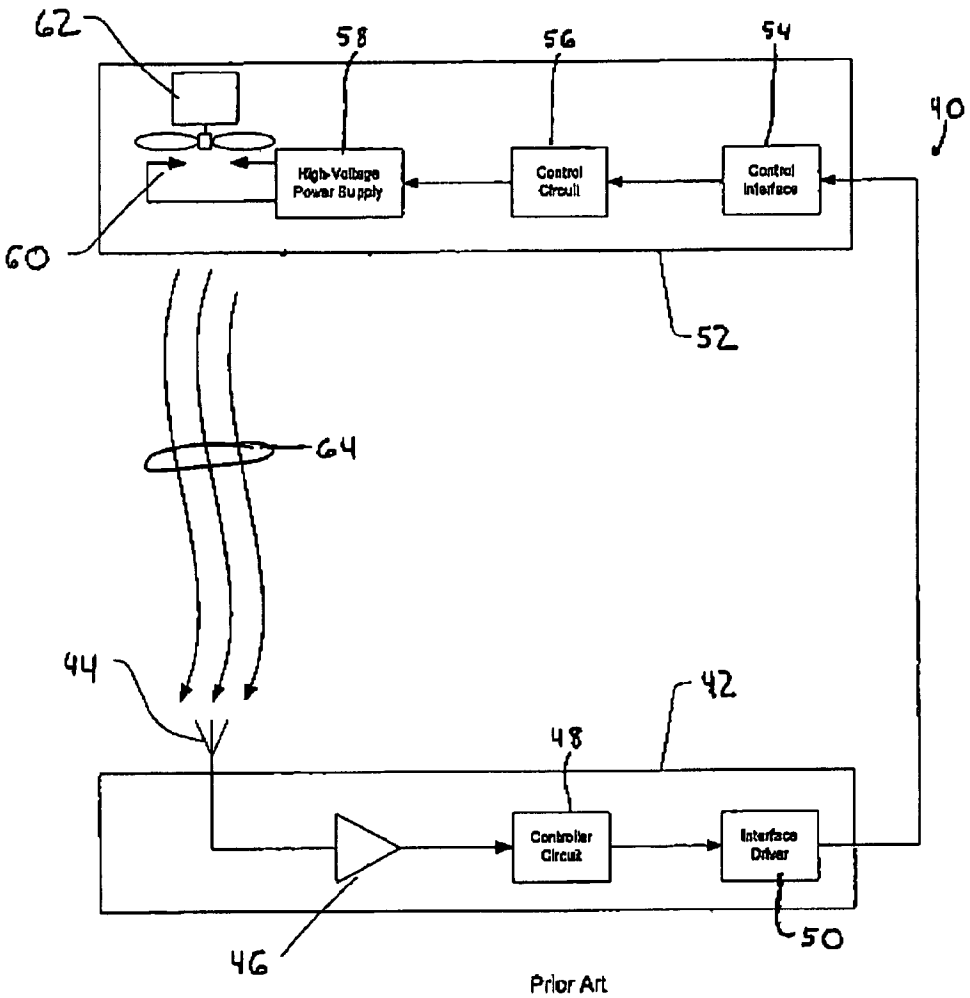
Figure 1 Prior Art
FIG. 1 is a diagram illustrating a typical ionization control system.

FIG. 1 depicts the block diagram of a typical ionization control system 40. As seen, a controller 42 consists of a sensing element 44 (such as antennae), a signal conditioning circuit 46, a control circuit 48 and an interface circuit 50 that sends signal from the sensor to an ionizer's control circuit. An ionizer 52 includes a control interface circuit 54 that receives the signals from the controller 42, a control circuit 56 which interprets the signal from the interface circuit, a high voltage power supply 58 that supplies power to the ionizing tips, a plurality of ionizing tips 60 that generate a corona of negative and positive ions and a fan 62 that generates a stream of ionized particles 64. The specific problem with this construction is that the controller is as sensitive to static voltage induced by an approaching charged objects as to the ionization imbalance caused by the ionizer 52. As a result, the ionizer 52 can be easily "thrown" out of balance by any charged object approaching the sensing element. The typical controller system is also prone to oscillations.

Figure 2:
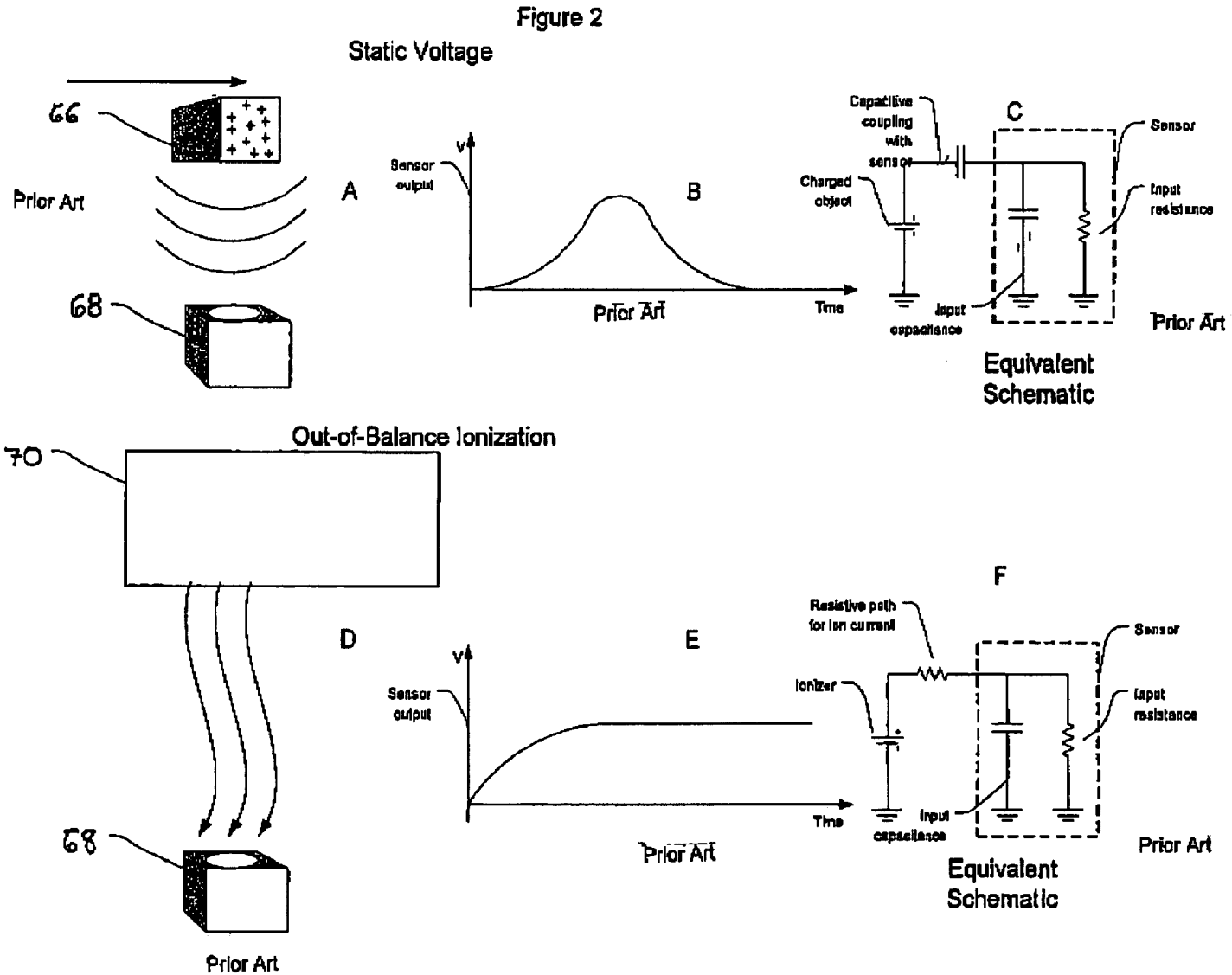
FIGS. 2*a*–2*f* illustrate examples of the effects of a charged object on the ionization balance of a sensor.

FIGS. 2A–2F illustrate the effects of a charged object 66 and ionization balance on an ionization sensor 68. As seen in FIG. 2A, the charged object 66 generates a capacitive coupling with the sensing element 68 due to the charges that are within the charged object 66. Therefore, with any path to ground (See FIG. 2C for an example of the equivalent electrical circuit), the voltage applied to the sensing element 68 reflects not the voltage on the charged object, but rather only changes of voltage. Thus, if a charged object 66 is brought in the proximity to the sensor 68, the voltage on the sensor over time would resemble the curve shown in FIG. 2B.

FIG. 2D shows a similar arrangement but with an ionizer 70 rather than with the charged object 66. In this arrangement, the charging of the sensing element occurs differently. In particular, instead of capacitive coupling, the ionization offers a current path with the properties of high-value resistor. The equivalent electrical circuit is shown in FIG. 2F. The resulting voltage on the sensing element 68 over time is shown in FIG. 2E. As seen, the fundamental difference between two scenarios is that, if there is path to ground from the sensing element, it is possible to differentiate between a charged object effect (See FIG. 2B) and a genuine ionization balance effect (See FIG. 2E). Even if there is no conductive path to ground from the sensing element 68, the induced voltage from the charged object (FIG. 2B) will still subside shortly because of the very fact of ionization that discharges charged objects. Now, an ionization controller in accordance with the invention that overcomes the limitations of typical systems will be described in more detail.

Figures 3A, 3B, 3C:
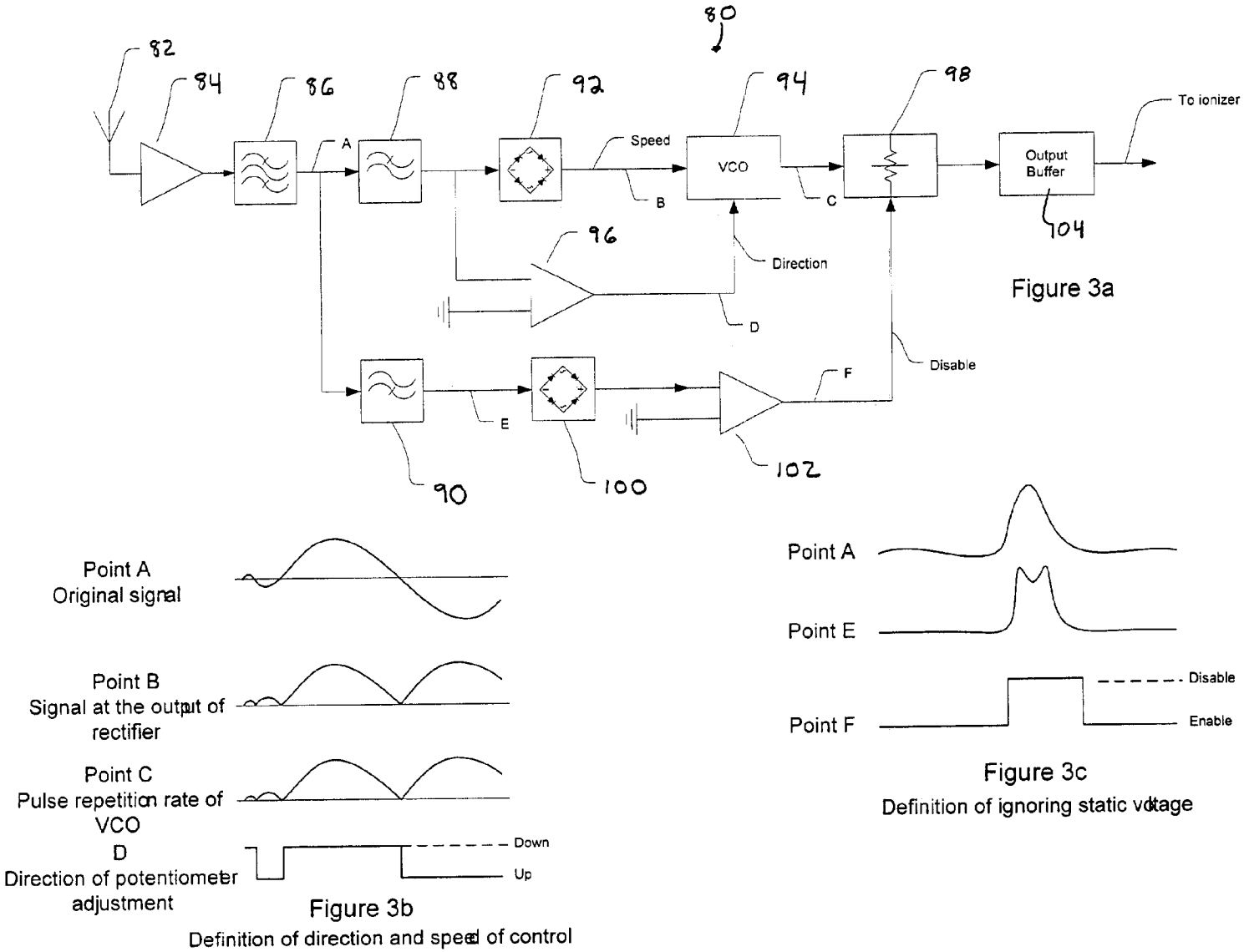
FIGS. 3*a*–3*c* are diagrams illustrating an analog implementation of an ionization controller in accordance with the invention, which provides rejection of the static voltage.

FIGS. 3A–3C are diagrams illustrating an analog implementation of an ionization controller 80 in accordance with the invention wherein FIG. 3A illustrates a block diagram of the analog ionization controller, FIG. 3B illustrates the waveforms generated by the controller shown in FIG. 3A and FIG. 3C illustrates the operation of the ionization controller in accordance with the invention that rejects static voltage caused by, for example, a charged object. Returning to FIG. 3A, the block diagram of the ionizer controller 80 in accordance with the invention that rejects the influence of static voltage while also reducing the possibility of oscillation of the controller is shown. An important advantage of the proposed invention is that, instead of a real-time closed-loop control that continuously adjusts balance of an ionizer, a different method in accordance with the invention of setting the control voltage is used which is roughly equivalent to manually adjusting the balance. The advantage of this method is that the control voltage can be easily held constant ("frozen") for the duration of an influence of a charged object which eliminates the unwanted effect of the charged object. In contrast, typical systems cannot provide this elimination of the charged object effect because the control in these typical systems is being adjusted all of the time.

As seen in FIG. 3A, a signal from a sensing element 82 is provided to a signal conditioning device 84, such as an operational amplifier, that normally would provide a very high impedance and, if necessary, gain. The sensing element 82 is preferably made of a material that is capable of receiving an electromagnetic signal. In one embodiment of the invention, the sensing element is a metal plate of the top cover of the ionizer controller. The signal from the signal conditioning device may be optionally filtered by a 50/60 Hz rejection filter 86 (also known as a band rejection filter that filters out a particular frequency range, such as 50–60 Hz.) This filter, though not absolutely necessary, improves the performance of the controller by rejecting the influence of the voltage (filtering out the 50–60 Hz voltage) on the AC mains. Instead of the band-rejection filter 86, other filters, such as low-pass filter, also could be used. The filtered signal output from the filter 86 is split and fed into a low-pass filter 88 and a high pass filter 90.

The low-pass filter 88 integrates the signal from the sensing element which averages the sensing element signal over time to reject small and rapid variations of balance that are present in many ionizers and cannot be effectively controlled using the present invention. A first full-wave rectifier 92 produces a one-polarity signal (which represents the speed of change of the sensing element signal) that is passed onto an input of a voltage-controlled oscillator 94. A lower voltage of signal output from the rectifier 92 results in a slower pulse rate of the voltage controlled oscillator (VCO) 94 since, when an ionizer approaches zero balance, the rate of balance change is reduced to avoid overshoots and oscillations which are undesirable. A first comparator 96, connected to the input of the first full-wave rectifier 92 determines the direction of control of a potentiometer 98 depending on the polarity of the input signal from the sensing element 82. The signal is fed into the VCO 94 which in turn generate the signal that is used to control the potentiometer 98.

The waveforms shown in FIG. 3B illustrate operation of this part of the circuit as described above. In particular, an input signal at point A (as shown in FIG. 3A) has a sine wave pattern and the rectifier 92 rectifies the input signal so that the output signal (at point B in FIG. 3A) has a voltage greater than or equal to zero. That rectified signal is used to control the VCO 94 which generates a similar signal at point C in FIG. 3A. The voltage from the comparator 96 compares the incoming signal to ground and generates an indication of whether the incoming signal is negative (down) or positive (up) at point D in FIG. 3A which is used to control the VCO 94 and the potentiometer 98.

Returning to FIG. 3A, the high-pass filter 90 passes only rapidly-changing signals. As described before, such rapidly-changing signals are an indication of the presence of static voltage and not of changes in ionization balance. The output from the high-pass filter (at point E) is fed into a second full-wave rectifier 100 which converts the bipolar signal (a signal having both positive and negative voltages) into a single-polarity signal. The output from the second rectified is fed into a second comparator 102. If the signal from the rectifier exceeds a pre-set level, the second comparator will generate an output signal (at point F) which will disable adjustment of the ionization balance by the digitally-controlled potentiometer 98. Thus, when a rapidly-changing signal is present (indicated an unwanted static voltage event), the potentiometer 98 is disabled which results in the ionization controller in accordance with the invention being able to ignore the static voltage events. Thus, if there is any incident of static charge approaching the sensor, any adjustments to the balance would cease until that incidence disappears. Therefore, during this static charge occurrence, there is no change in the balance control meaning that the static voltage cannot affect ionizer balance. FIG. 3C illustrates the waveforms of the signals at different parts of the circuit and illustrate the operation of this portion of the circuit. In particular, a signal at point A results in an output of the high-pass filter at point E as shown which in turn results in a control signal from the comparator at point F which disables the potentiometer 98.

The output of the potentiometer 98 is fed into a buffer 104. The output of the buffer 104 is a control signal that is used to control the balance of the ionizer. In accordance with the invention, such parameters as VCO speed and rate change, the threshold of the second comparator and other well known parameters of the circuit shown in FIG. 3A, can be adjusted for the best performance with a particular ionizer. As can be seen, FIG. 3A is an analog implementation of the ionization controller in accordance with the invention. Now, a digital implementation of the ionization controller in accordance with the invention will be described.

Figure 4:
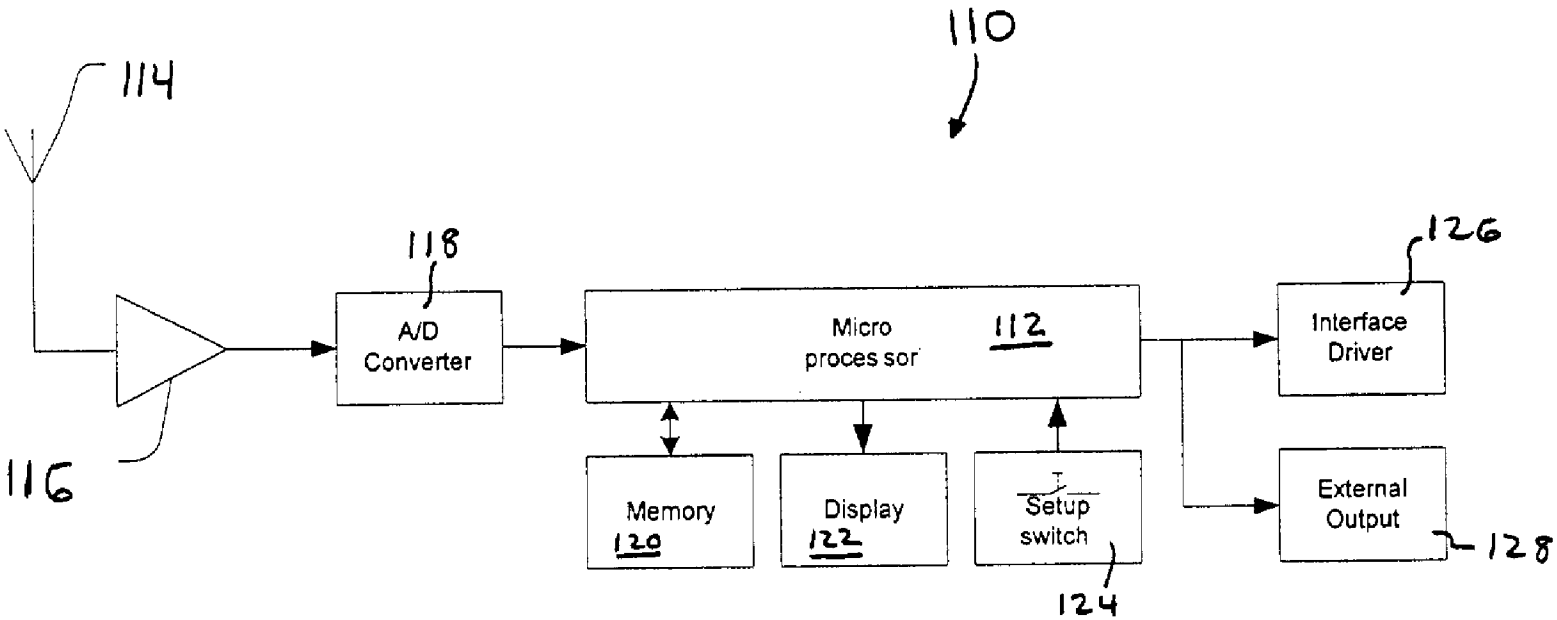
FIG. 4 illustrates an example of a microprocessor-based (digital implementation) ionization control system in accordance with the invention.

FIG. 4 is an example of a digital implementation of an ionization controller 110 in accordance with the invention in which a microprocessor 112 (or microcontroller) may be used and most of the functions (the rectification, filtering, comparison and control) are performed in the firmware (software code or a series of instructions) being executed by the microprocessor. In FIG. 4, a sensing element 114 is connected to a signal conditioner circuit 116 whose output is then connected to the input of an A/D (analog to digital) converter 118 that may be either a separate component or a part of the microprocessor 112. The microprocessor has a memory 120 (often embedded) which is preferably read/write memory, and a display 122 for outputting visual data. A switch 124 (shown as a set-up switch in FIG. 4) permits the operation of the microprocessor to be controlled. The controller 110 may further comprise an interface driver 126 that provides an output signal to a control input of the ionizer being controller by the controller 110. The interface driver 126 may be implemented as an analog buffer and/or filter. Similarly, if a microprocessor provides a digital interface to the ionizer, then no interface driver may be necessary. An external output module 128 provides various signals to external data collection or alarm mechanisms and systems. Now, the operation of the microprocessor based ionization controller will be described in more detail.

Figure 5:
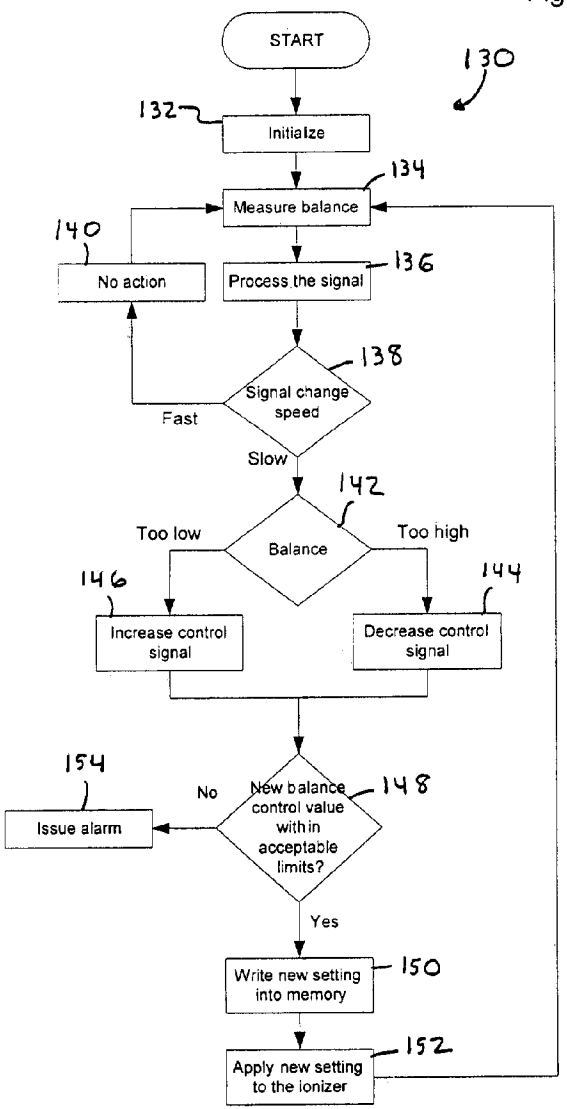
FIG. 5 is a flowchart illustrating the operation of the system shown in FIG. 4.

FIG. 5 is a flowchart illustrating the operation of the digital ionization controller shown in FIG. 4 and in particular an ionizer control method 130 in accordance with the invention. In a preferred embodiment, this method may be carried out by the system in FIG. 4 and the microprocessor shown in FIG. 4 that is executing pieces of software code/instructions to implement the functions being described. For all of the methods described herein, a microprocessor of the controller preferably implements the methods using software code/instructions although the methods may also be implemented by other devices that are capable of executing instructions. It is also possible to implement the described methods with discrete components or by other methods.

In step 132, the controller system is initialized. In step 134, the controller system measures the balance of the ionizer system so that the controller system measures the balance signal coming from its sensor and processes the signal (in step 136), such as applying the 50/60 Hz rejection filter described above, etc. Once the incoming balance signal has been processed, the processed signal is analyzed for the speed of change of the signal in step 138. If the speed of change of the signal is too fast, then no action is taken (step 140) and the method loops back to step 134 (which means that the method rejects the rapidly-changing signals indicative of a static voltage). If the speed of change of the balance signal is sufficiently slow (e.g., about 0.1 V per second) (indicating an actual ionization imbalance), the method adjusts the balance in step 142. In particular, if the balance is too low, then the control signal is increased in step 146 and if the balance is too high, then the control signal is decreased in step 144 so that the control signal is changed in accordance with the balance value in order to bring the balance back to zero. In step 148, the method determines if the new balance control value is within an acceptable range, such as within the range that would give an ionizer an offset of about +/−20V. If the new control signal value is within the acceptable range (the balance is being adjusted within some range of values), the new setting is accepted and stored in memory in step 150, the new control signal is provided to an ionizer in step 152 and the method loops back to step 134. If the new control signal is outside of the acceptable range, then an alarm is issued in step 154.

In the above method, the ionization balance adjustment occurs when the rapidly changing signal is no longer being sensed by the sensor element. In some situations, it may be desirable to wait for some predetermined time following a rapidly changing signal to reject inaccurate signals. Therefore, the method above may alternatively wait for some predetermined time period (e.g., 1 to 10 seconds or may be adjustable based on the particular ionizer characteristics and environment of the ionizer being controlled) prior to permitting the adjustment of the ionizer balance after the rapidly changing signal.

The method of processing the digital representation of the analog signal as generated by the A/D converter may be done by standard digital signal processing techniques, such as infinite impulse or finite impulse response digital filters. The filters could be implemented as a direct conversion of the analog circuits shown in FIG. 3 or may be conjugated into a single filter routine/algorithm.

In order to prevent the jitter of balance in some ionizers, the controller method described above may further set a "dead band" where no adjustment to balance occurs if the ionizer balance is within a pre-determined closed limit. For example, if the balance is measured within +/−0.5V, then no balance control adjustment may be issued. The "dead band" contributes to the stability of the entire ionizer/ionizer controller system. To implement the "dead band", the "dead band" may be stored within the microprocessor (or its memory) of FIG. 4 during initialization so that the microprocessor is able to disable the control of the ionizer when the ionizer balance is within the "dead band" range. The ionization controller in accordance with the invention may also adjust the speed of the balance adjustment. Thus, as the balance approaches the desired ionizer balance, the amount of change of the balance (due to the adjustments) are reduced to avoid overshoot as described above with reference to FIG. 3A.

There are many ionizers currently on the market. All of these different ionizers do not have the same sensitivity to a control signal and do not have the same timing response parameters. It is therefore beneficial to provide a technique for adjusting the ionizer controller parameters to a specific ionizer. The adjustment may be done manually using the potentiometer at the output of ionizer controller to scale the control signal. However, such manual adjustment is difficult because there are no set parameters to which a person can make the adjustments. Therefore, an automated parameter adjustment method in accordance with the invention will now be described.

Figure 6B:
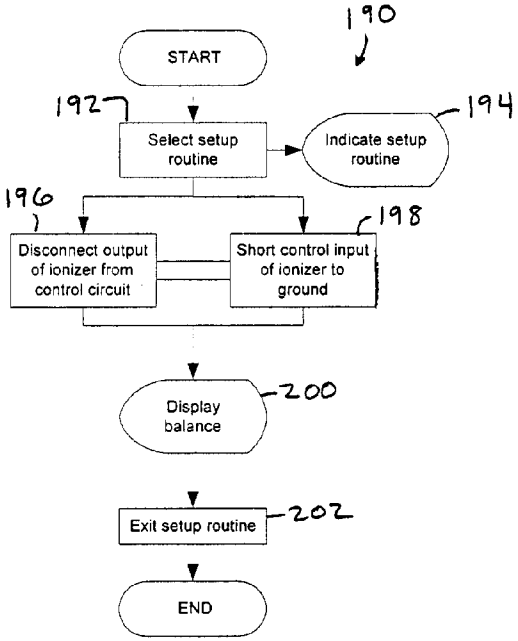
FIGS. 6*a* and 6*b* illustrate a learning process and set-up process of the ionization control system in accordance with the invention.
Figure 6A:
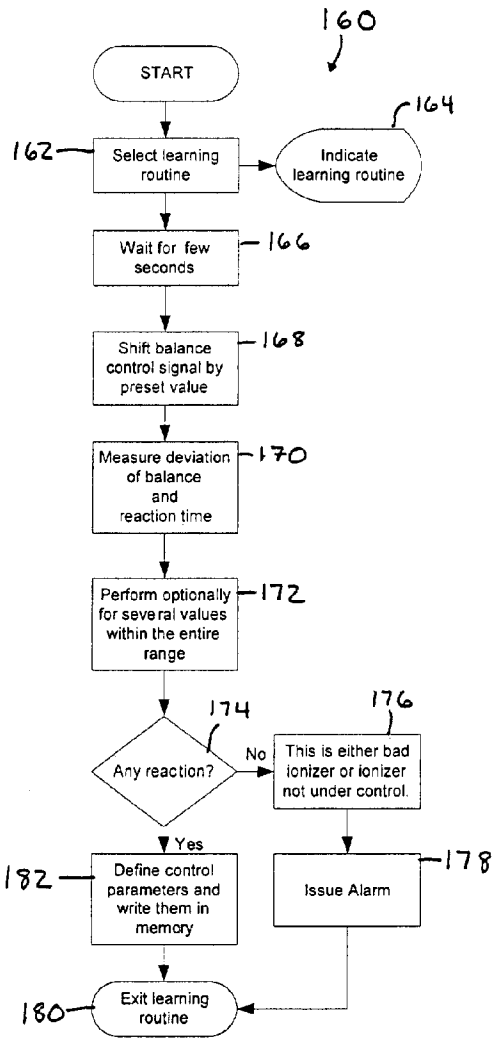

FIG. 6A is a flowchart of a learning routine 160 in accordance with the invention that automatically adjusts the parameters of the ionizer controller 110 shown in FIG. 4. In accordance with the invention, the learning routine, in one of the embodiments of the proposed invention, is invoked by depressing the setup switch (shown in FIG. 4) before powering down the controller 110, powering on the controller 110 and then releasing the setup button. An indicator LED(s) (shown in FIG. 13C) would show that the ionizer controller 110 is in a learning/set-up mode.

As shown in FIG. 6A, the method 160 may start when a learning routine is selected (for example, each different type of ionizer that may be controlled by the ionizer controller in accordance with the invention may have a different learning routine so that user must select the particular learning routine for the particular ionizer) in step 162 and the selected learning routine is displayed in step 164 to the user. The ionizer controller may further include a generic learning routine which is applicable to any ionizer. After the selection of the learning routine, a several second waiting period (in step 166) is provided to allow for the operator to place ionizer controller under the blower and to move away from the controller so as not to affect the adjustment. In step 168, the ionizer controller (implementing the learning routine)

may apply pre-determined control voltage(s) to the ionizer in order to shift the balance control signal by a preset value. In step 170, the ionization controller measures the deviation of the balance, the polarity of the control mechanism, the rate of change of the balance and the time that it took for the ionizer to achieve the new balance. In step 172, the ionizer controller may optionally further offset the ionizer by other control signals of different magnitude and polarity within the preset limit. In step 174, the ionizer controller determines if the ionizer reacted to the change of the control signal. If no reaction from an ionizer is observed to the different control signals, the ionizer controller may conclude (in step 176) that there is either no ionization (a bad ionizer) or that the ionizer cannot be controlled and issue an appropriate alarm in step 178 and exits the learning routine in step 180. If the ionizer does react to the control signals, the microprocessor then calculates, in step 182, appropriate control signal range for this particular ionizer as well as its timing response to balance changes and saves the settings in its non-volatile (FLASH, EEPROM, etc.) memory and exits the learning routine in step 180. After that, ionizer controller begins to provide balance control of ionizer.

In some applications, it may be desirable to quickly bring the ionizer balance to zero after powering on the system. In this case, the ionization controller may power on as a simple PID (proportional/integral/derivative) controller for a pre-determined time and then switch to the control shown in FIG. 5. The time prior to the switch from the PID mode may be fixed or determined by detecting a stable balance at zero volts. This fast start-up function can be added to either a digital or analog embodiment.

It is often necessary to perform periodic adjustments to the ionizers even though the ionizer may be controlled by the ionizer controller. Typically, a worker would move from one workstation to another with a charge plate monitor in order to properly adjust the ionizer balance and to check its decay. However, this process takes valuable time and requires a dedicated employee. In accordance with the invention, an automated setup routine is described below which removes the need for the manual adjustment.

FIG. 6B illustrates a setup routine 190 in accordance with the invention that eliminates the need for the manual adjustment with the charge plate monitor. The setup routine preferably may be a series of computer instructions executed by the microprocessor shown in FIG. 4. As an example, in order to enter the setup routine, a user needs to momentarily depress the setup switch 124 shown in FIG. 4. When the setup switch 124 is depressed, the microprocessor then discontinues control of ionizer balance and selects the setup routine in step 192 which is displayed to the user in step 194. The microprocessor may then cease to provide control to the ionizer in different manners depending on the particular construction of the ionizer being controlled. Thus, the microprocessor may either disconnect its output from the ionizer in step 196 or short the control input to the ionizer to ground (provide a zero voltage to the output of the controller) in step 198. In step 200, the current balance of the uncontrolled ionizer is displayed. For example, an LED bar graph or other indication (such as that shown in FIG. 13C) on the ionizer controller may show the balance of the uncontrolled ionizer. Then, the user may manually adjust the balance of the ionizer until the balance is within allowable tolerances as indicated by the display on the ionizer controller. After adjustment is finished, the user may momentarily depress the setup button again in order to switch the ionizer controller into control mode and out of the setup mode in step 202. The above setup routine also may be performed with an ionizer controller built on discrete components (such as the circuit shown in FIG. 3A) where the setup switch would disconnect or ground the input of the ionizer from the control circuit.

The devices and systems of FIGS. 1–4 described above show a separate ionizer controller. However, the ionization controller in accordance with the invention may also be implemented as an integrated ionizer controller as will now be described in more detail.

Figure 6C:
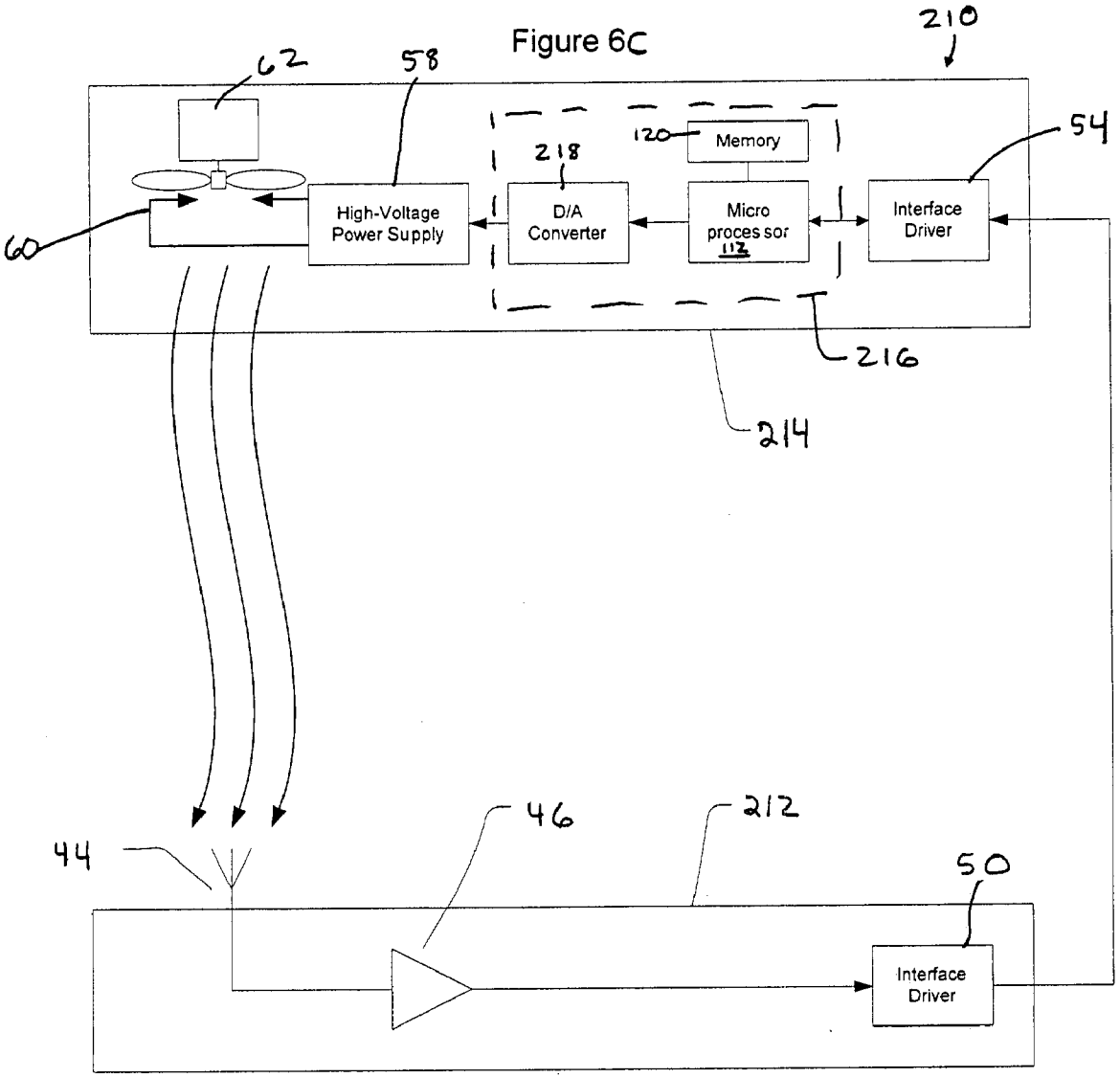
FIGS. 6*c* and 6*d* illustrate an analog and a digital interface, respectively, between the sensor and integrated balance controller in accordance with the invention.
Figure 6D:
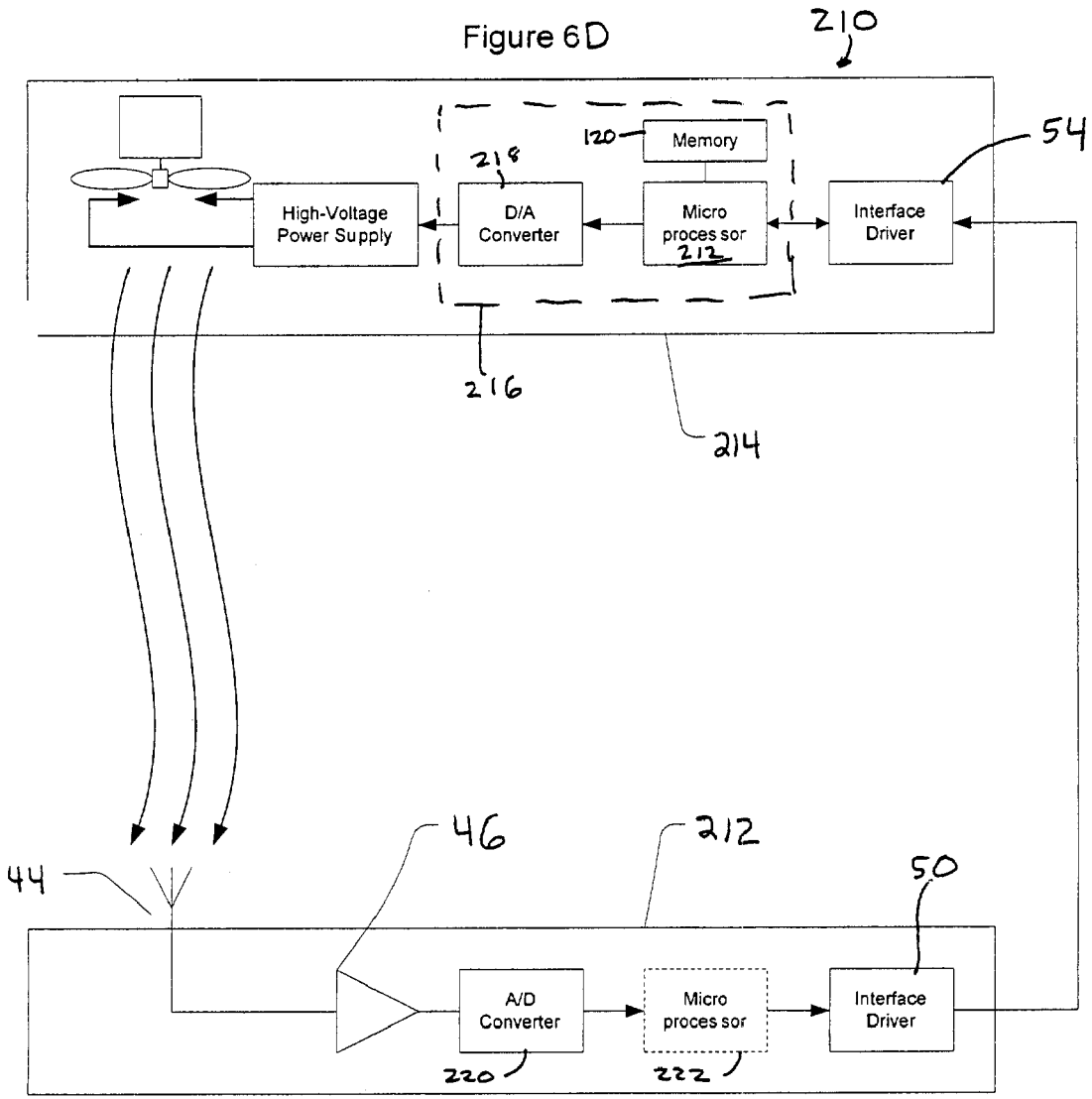

FIGS. 6*c* and 6*d* show an integrated ionizer controller 210 in accordance with the invention. FIG. 6*c* illustrates an example of an analog implementation of the integrated ionization controller 210 while FIG. 6*d* illustrates an example of a digital implementation of the integrated ionization controller 210. In both of these implementations, a sensor 212 only provides raw information about the balance to an ionizer 214 and an internal control circuit 216 of the ionizer in accordance with the invention performs the same function as was described above. The internal circuit 216 may include the microprocessor 112 as described above, the memory 120 as described above and a D/A converter circuit 218 which converts the digital output from the microprocessor into an analog control signal for the ionizer. The internal circuit for the digital implementation shown in FIG. 6*d* is the same. However, for the implementation in FIG. 6*d* in which the sensor output is converted to a digital format, the sensor 212 further include an A/D converter circuit 220 and a microprocessor 222 which convert the analog sensor signal into a digital signal that is provided to the internal control circuit 216 of the ionizer 214. In both implementations shown in FIGS. 6*c* and 6*d*, if a sensor is unplugged, the ionizer retains the last control value corresponding to zero balance which is useful for periodic auto-zeroing of balance when it is impractical to have permanent sensor present. In all of the above figures (FIGS. 1, 3A, 4, 6*c* and 6*d*), power to the sensor can be provided from the ionizer or separately from another power source.

Ionizer decay is a fundamental well known property of an ionizer. The decay may be reduced by dirty ionization points in corona ionizers, by insufficient air flow and other factors. Although a periodic decay test is often administered along with the balance test, it is beneficial to be continuously alerted to decay failures in critical electrostatic discharge (ESD) environments instead of only when the periodic decay test is administered. In accordance with the invention, a decay test apparatus in accordance with the invention that is capable of determining the decay of the ionizer continuously is now described.

Figure 7:
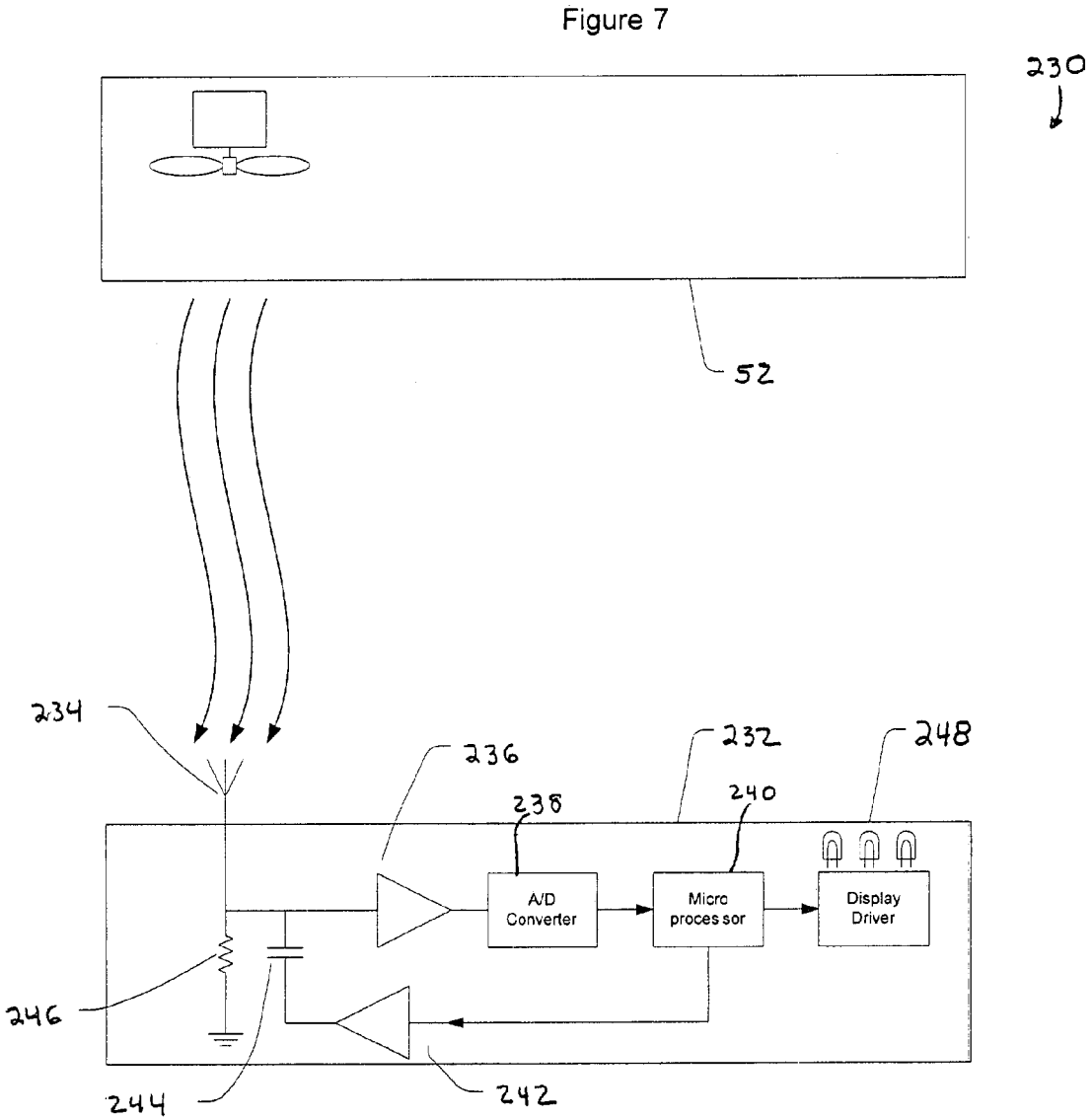
FIG. 7 is a diagram illustrating an ionizer decay indicator in accordance with the invention.

FIG. 7 is a diagram illustrating a decay test apparatus 230 which measures the decay of the ionizer 52. As shown, the decay apparatus 230 includes a sensor 232 that includes a sensor element 234. Periodically, the sensor element 234 is charged to a preset voltage and then the decay of the preset voltage associated with the sensor element, due to ionization, is measured. In one embodiment, the time of decay from the initial voltage to another, lower, set voltage is measured. In another embodiment, the gradient of the decay of the voltage over time is measured. If needed, the resulting decay figure may be correlated to the decay measured under identical conditions by a standard charged plate monitor and then the data of decay measurements done by the device of the proposed invention can be presented in values correlated to a standard charged plate monitor.

FIG. 7 shows one of the embodiments of the decay apparatus 230. The decay apparatus is similar to the sensors described above. In particular, a signal from sensor element 234 passes through a signal conditioning circuit 236 and enters an A/D converter 238. A microprocessor 240 periodically alters the logic level of the signal to a buffer 242 which feeds the signal into a capacitor 244. The buffer 242 can be a part of microprocessor or a separate circuit. In FIG. 7, the buffer 242 is shown as a separate device for the purposes of illustration of the operation of the device. When a "1" logic level is applied to the buffer, the right side of the capacitor 244 is charged to a positive supply voltage (i.e. +5V) and the sensor element 234 receives the same voltage due to capacitive coupling. In the absence of ionization, the voltage on the sensor element 234 would be reduced at the rate that is a function of the resistance of a resistor 246 and the input resistance of signal conditioning circuit 236. This rate of discharge can be easily stored in the microprocessor's memory as a reference value. As is well known, the ionization would accelerate the voltage decay. By measuring the difference between actual decay and the abovementioned reference decay, it is possible to calculate the decay caused by the ionization.

When the output of microprocessor 240 switches to a logic level "0", then the sensor element 234 is charged to a negative supply voltage (i.e. −5V) because of the voltage retained and stored on the capacitor 244. The negative supply voltage permits the decay to be tested for the opposite polarity of the voltage. Then the average of the both decay values (the positive voltage decay value and the negative voltage decay voltage) can be calculated. For the purpose of better accuracy, the tests may be performed several times and the results are averaged. Once the decay value is determined as described above, the sensor 232 may comprise a decay indicator 248, such as a display driver and one or more LEDs, which display the determined decay value.

Figure 7B:
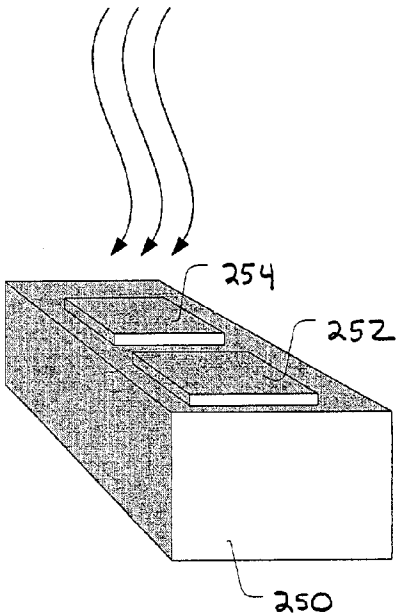
FIG. 7*b* is a diagram illustrating more details of the combined decay/balance sensor in accordance with the invention.
Figure 7A:
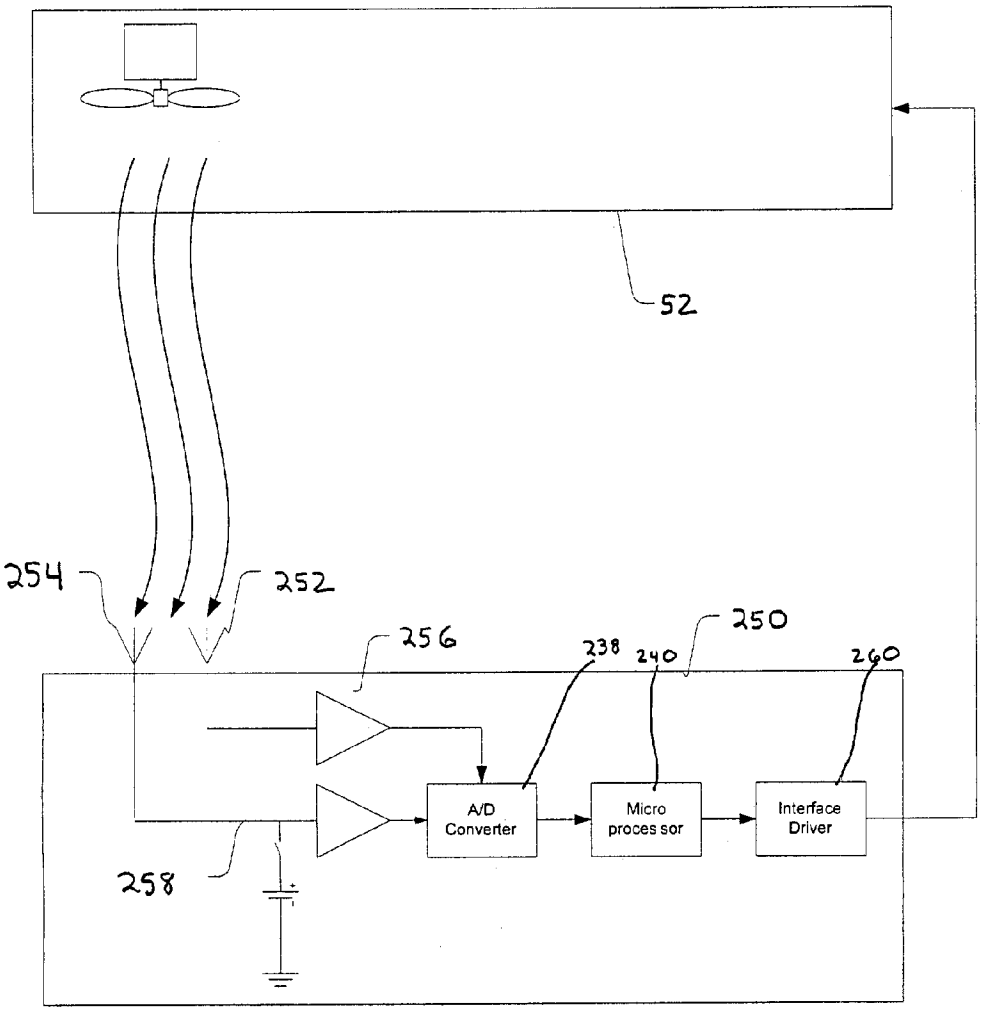
FIG. 7*a* is a diagram illustrating a combined decay/balance sensor and system in accordance with the invention.

FIGS. 7*a* and 7*b* show a combined decay/balance sensor 250 where a balance sensing element 252 and a decay sensing element 254 are separated. This arrangement allows for the independent operation of balance monitoring and the decay monitoring. In particular, a balance test path 256 and a separate decay test path 258 are shown. Then, the signals from these two test paths are fed into the A/D converter 238 and the microprocessor 240 so that a control signal is generated by an interface driver 260 to the ionizer 52.

FIGS. 8*a* and 8*b* illustrate a decay test method 270 in accordance with the invention. For the most accurate results of the decay test, the balance of ionizer during the test must be zero or as close to zero as possible. Therefore, in step 272, the microprocessor determines if the balance of the ionizer is zero. If the determined balance of the ionizer is not zero, the method goes to a balance control step 274 to balance the ionizer. If the balance of the ionizer is near zero, then the microprocessor may set the output of the gate/buffer high in step 276. In step 278, the sensor element is charged to a positive voltage and the decay of the positive voltage is monitored in step 280. In step 282, the gate/buffer output is set low and the sensor element is charged to a negative voltage in step 284. In step 286, the decay of the negative voltage is monitored. In step 288, the microprocessor determines/calculates the decay of the ionizer (by averaging the position voltage decay and the negative voltage decay). In step 290, the microprocessor determines if the calculated decay is within the normal range (for example, by comparing the calculated decay to the normal decay value stored in the microprocessor or its memory). If the decay is not within the normal range, then an alarm is issued in step 292. If the calculated decay is within the normal range, then the method pauses in step 294 before the next decay step and loops back to step 274.

Typically, the decay test lasts several seconds. If, during one of such tests the airflow is accidentally blocked by an operator or a charged object induces voltage into the sensor element, a distorted measurement occurs which potentially causes irritating false alarms. As is well known, ionization decay does not change abruptly by its nature. Therefore, the device of proposed invention makes several consecutive decay measurements and, out of the several (in one of the embodiment—three) measurements, selects the lowest decay as not to create false alarm, as shown in FIG. 8*b*.

Figure 9:
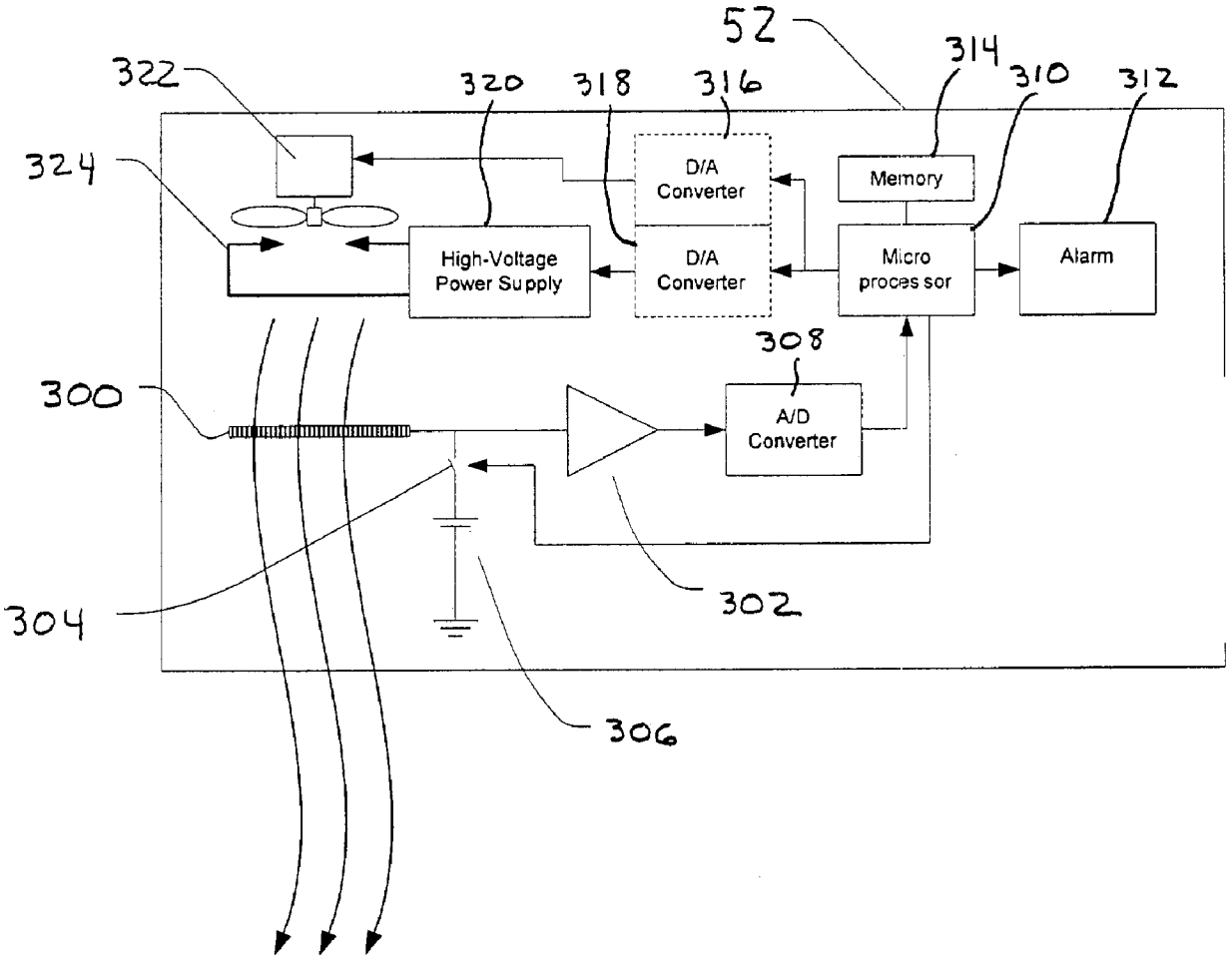
FIG. 9 is a diagram illustrating a local decay controller in accordance with the invention.

FIG. 9 is a diagram illustrating a local decay controller in accordance with the invention shown integrated into an ionizer 52. In particular, to provide a local decay test, it can be accomplished using a grill 300 on the ionizer 52 at the exit of air flow. The grill 300 functions as the sensor element described above. The local decay controller further comprises a signal conditional circuit 302, a switch mechanism 304, a voltage source 306, an A/D converter 308, a microprocessor 310, an alarm mechanism 312, a memory 314, a first D/A converter 316 and a second D/A converter 318. The ionizer may include a high-voltage power supply 320, a fan and motor 322 and ionization tips 324. As seen in FIG. 9, the voltage source 306 (which may be, for example, a capacitor) charges the grill (sensor element) 300 via a switching circuit 304 that are controlled by the microprocessor 310. As shown, the signal from sensor element 300 passes through the signal conditioning circuit 302 and then is converted into a digital signal by the A/D converter 308 which could be internal to the microprocessor 310. The operation of the decay measurements is similar to the one described above for FIGS. 7, 7*a*, 7*b*, 8*a* and 8*b*.

The decay of ionization is normally measured in accordance with such standards as ANSI/ESD STM3.1-2000 and ESD SP3.3-2000, which presume the use of 6"×6" metal plate with capacitance of 20 pF. In reality, it is impractical to have such a large monitoring plate in the work environment. It is possible, though, to experimentally correlate measurements of decay done with a smaller sensor element and measurement done with a "standard" plate with sufficient degree of accuracy. In accordance with the invention, the decay test apparatus in accordance with the invention is capable of measuring the decay with a smaller plate and then, using a method, such as a look-up table or similar method, present data correlatable to a standard plate measurements.

Returning to FIG. 9, the local decay controller is capable to controlling the decay by a plurality of different mechanisms. As shown in FIG. 9, the control signals from the microprocessor 310 may be applied to the fan 322 (through the D/A converter 316) to control the speed of the fan or the control signals may be applied to the high voltage power supply 320 from the D/A converter 318 to control the corona generated by the ionizer. In accordance with the invention, the worse the decay, the higher the voltage on the output of the high-voltage power supply and/or the higher the speed of the fan.

The control of the decay using the built-in sensor in the ionizer (in FIG. 9) does not account for problems with airflow passing to the covered area. For example, if the airflow is not aligned properly or if it is blocked, or if ionized air blows into grounded metal, the ionization decay at the ionizer can be satisfactory, but at the controlled area it may be insufficient. Therefore, a combination of remote sensor shown in FIG. 7 and the local sensor of FIG. 9 may be used to provide a more comprehensive decay indication and control.

Figure 10:
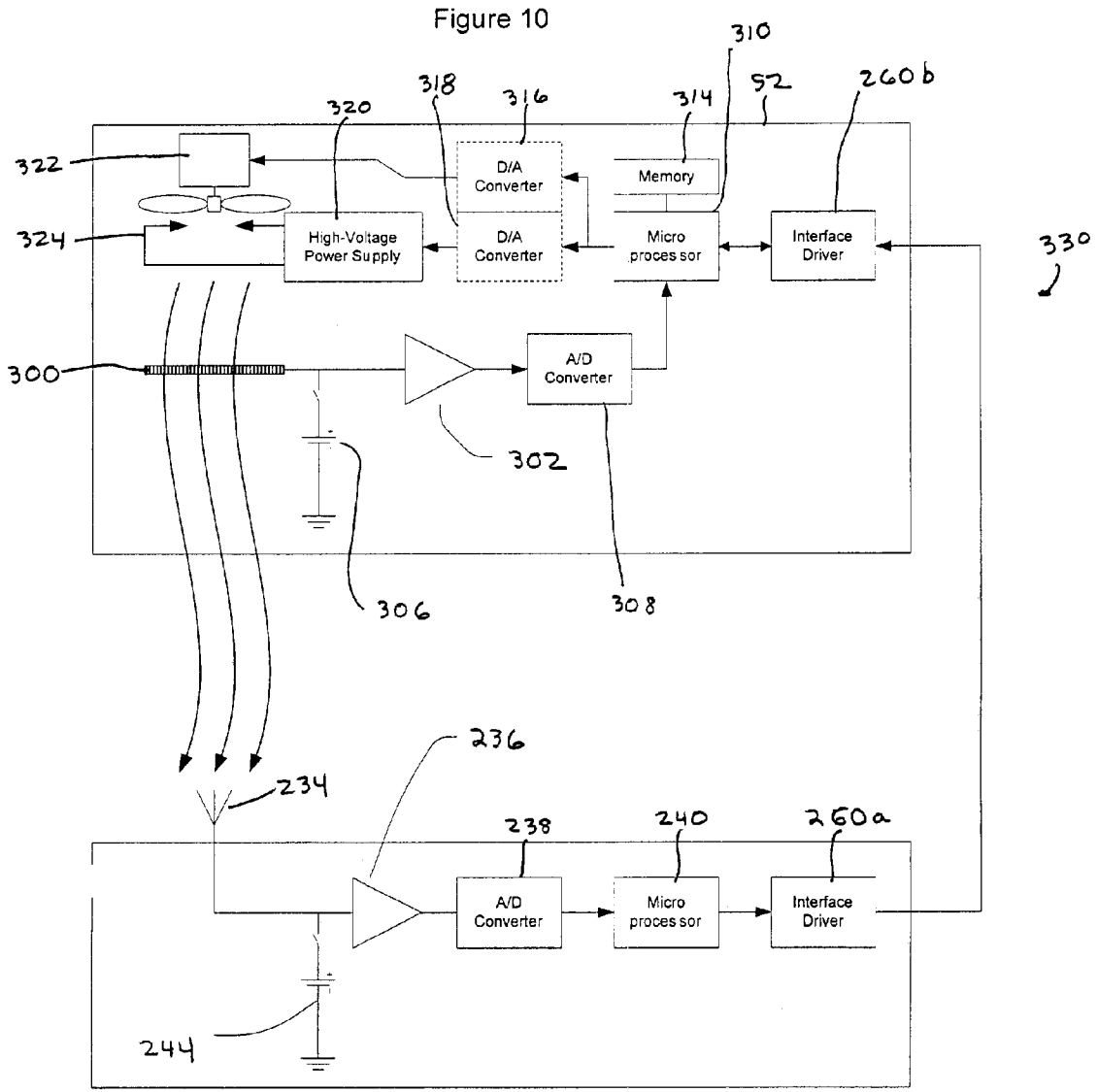
FIG. 10 is a diagram illustrating a dual-loop decay controller in accordance with the invention.

FIG. 10 illustrates an example of a dual loop decay controller 330 that include the local decay sensor 300 (from FIG. 9) as well as the remote decay sensor element 234 (from FIG. 7.) The similar elements in FIG. 9 and FIG. 7 have like reference numerals and those elements and their operation will not be described herein. In accordance with the dual loop decay controller in accordance with the invention, the decay of the ionizer is measured by both sensor elements 300, 234 wherein the remote sensor element 234 is able to identify airflow problems that cause a change in the decay measurement while the local sensor element 300 accurately measures the decay at the ionizer.

Figure 11:
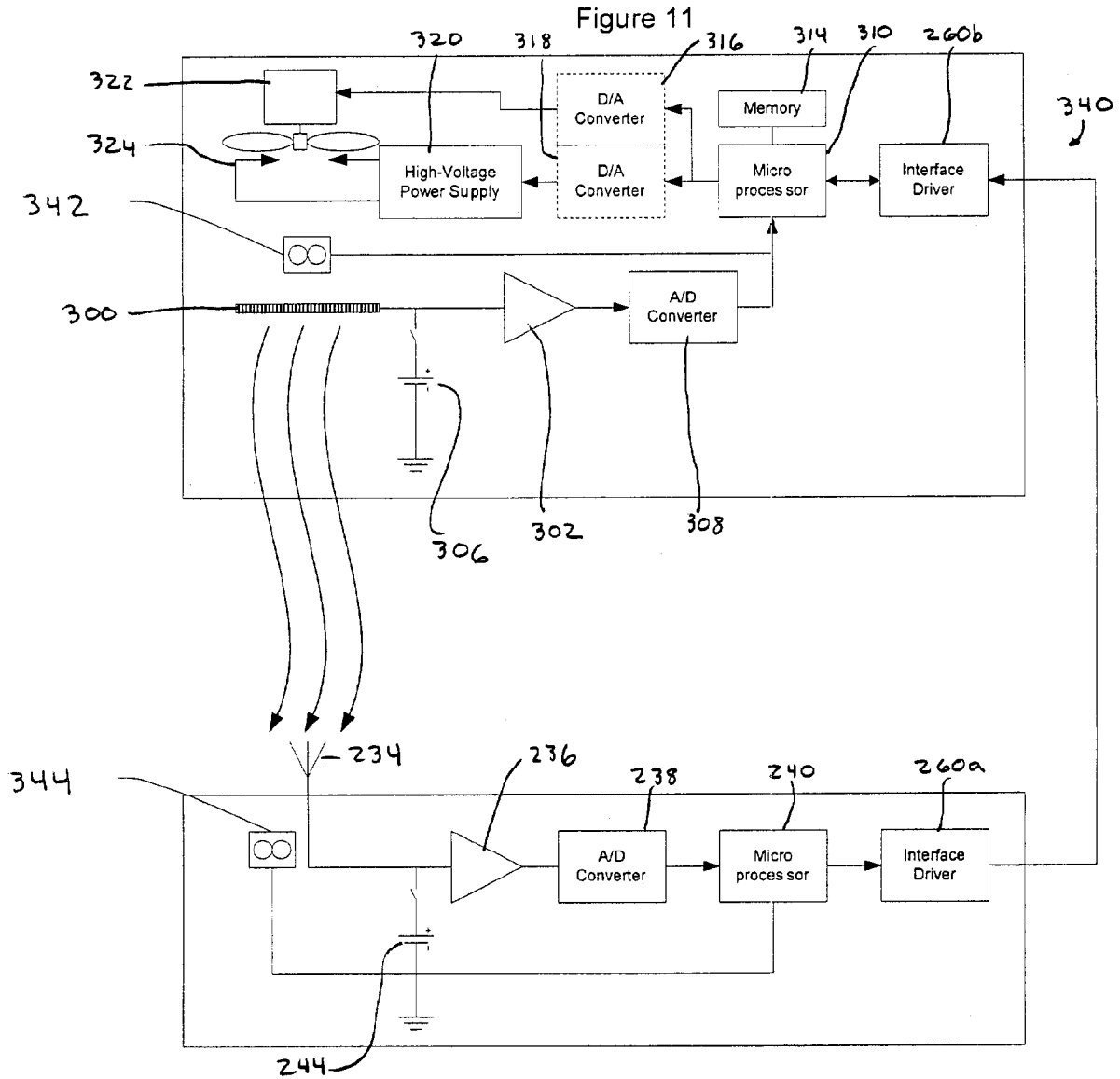
FIG. 11 is a diagram illustrating a dual-loop decay and air flow controller in accordance with the invention.

FIG. 11 shows a dual-loop decay and airflow controller 340 in accordance with the invention. In this embodiment, a further improvement of the decay control is provided by providing well known airflow sensors in the ionizer itself either/or in the remote sensor. The other element shown in FIG. 11 are similar to the elements shown in FIG. 10 above (and the similar elements have identical reference numbers) and will not be further described here. In this embodiment, there may be an ionizer airflow sensor 342 and/or a remote airflow sensor 344 as shown. The data from the airflow sensor(s) 342, 344 can be used to generate an alarm when there is insufficient air flow and/or to control the fan speed to optimize airflow.

Figure 12C:
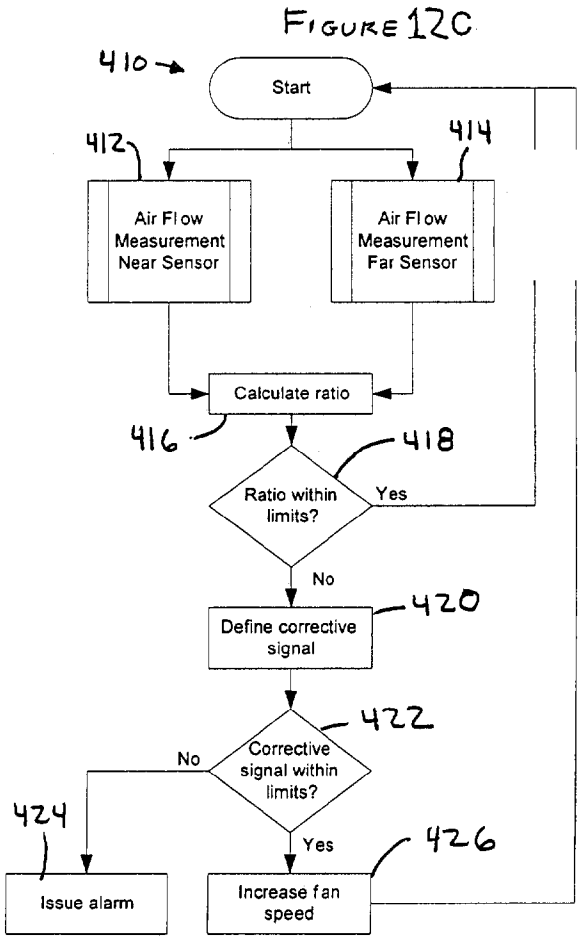
FIGS. 12A–12C are flowcharts illustrating the operation of the controller shown in FIG. 11.
Figure 12B:
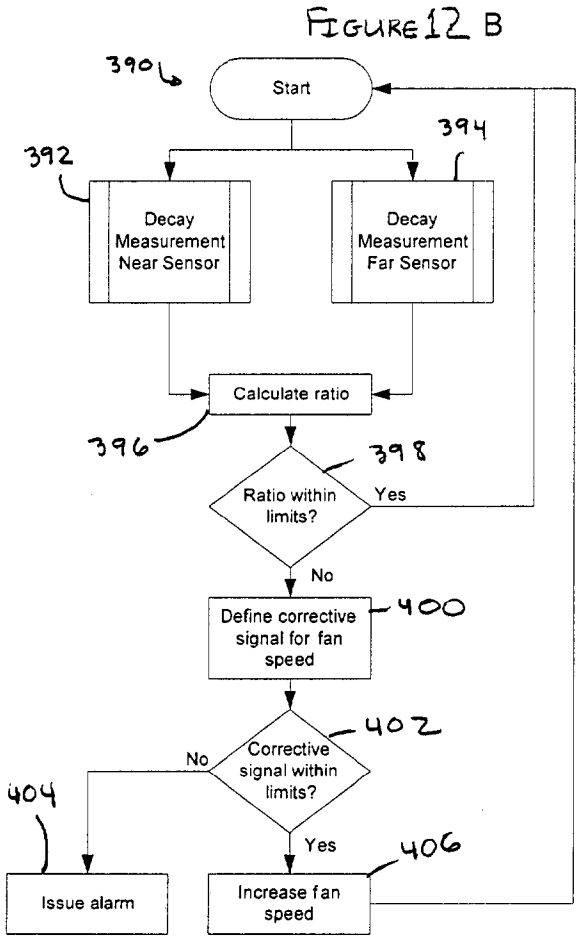
Figure 12A:
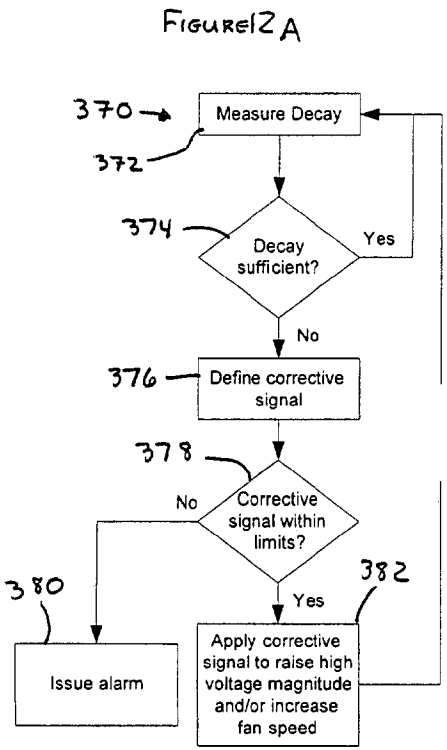

FIGS. 12A–12C are flowcharts depicting the operation of the dual-loop decay and airflow controller shown in FIG. 11. In particular, FIG. 12A illustrates a method 370 for controlling of decay by high voltage, FIG. 12B illustrates a method 390 for controlling the decay by airflow and FIG. 12C illustrates a method 410 for controlling airflow. As shown in FIG. 12A, in step 372, the microprocessor measures the decay. In step 374, the microprocessor determines if the decay is sufficient (for example by comparing the decay to a stored normal decay value) and loops back to step 372 of the decay is sufficient. If the decay is not sufficient, then the microprocessor determines a corrective signal to apply to the high voltage power source in step 376. In step 378, the microprocessor determines if the corrective signals are within the acceptable limits (for example, by comparing the determined corrective signal to a normal range of corrective signals) and generates an alarm in step 380 if the corrective signal is not within the normal limit. If the corrective signal is within the normal range, then the microprocessor applies the corrective signal in step 382 in order to raise the high voltage magnitude and/or increase the fan speed. The method then loops back to step 372 and measures the decay again.

FIG. 12B illustrates the method 390 implemented by the microprocessor in which the decay measurement for the grill (the sensor element in the ionizer) is determined in step 392 and the decay measurement for the sensor element in the sensor (the sensor far from the ionizer) is determined in step 394. In step 396, the microprocessor determines the ratio of the two decay measurements. In step 398, the microprocessor determines if the calculated ratio is within the limits (for example by comparing the calculated ratio to a normal ratio value stored in the memory of the microprocessor) and loops back to step 392 and 394 if the ratio is within the limits. If the ratio is not within the limits, then the microprocessor a corrective control signal for fan speed is determined in step 400. In step 402, the microprocessor determines if the corrective signal is within the limits (for example by comparing the calculated fan speed control signal to a normal fan speed control signal stored in the memory of the microprocessor) and issues an alarm if the correct fan speed control signal in step 404 of the corrective signal is not within the limits. If the corrective fan speed control signal is within the limits, the fan speed is increased in step 406 (as a result of the corrective signal control signal) and the method loops back to step 392 and 394 as shown.

FIG. 12C is a flowchart of the method 410 for controlling airflow in accordance with the invention. In the method, the airflow in the ionizer in step 412 and the airflow in the sensor in step 414 are measured. In step 416, the ratio of the two airflow measurements is determined by the microprocessor and the microprocessor determines if the ratio is within the normal limits (for example by comparing the calculated ratio to the normal range of ratios stored in the memory of the microprocessor) in step 418. If the ratio is within the normal range, then the method loops back to steps 412, 414 and measures the airflows again. If the ratio is not within the normal range, then the microprocessor determines/calculates a corrective signal in step 420 and then determines if the corrective signal is within the normal range (for example by comparing the calculated corrective signal to a normal range of corrective signals stored in the memory of the microprocessor) in step 422. If the corrective signal is not within the normal range, then the microprocessor issues an alarm in step 424. If the corrective signal is within the normal range, then the fan speed is increased in step 426 and the method returns to steps 412, 414 to re-measure the airflows.

Figure 13C:
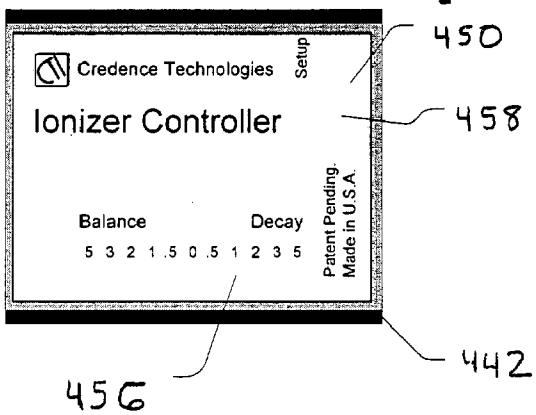
FIGS. 13A–13D illustrate an example of an implementation of the ionization controller in accordance with the invention.
Figure 13D:
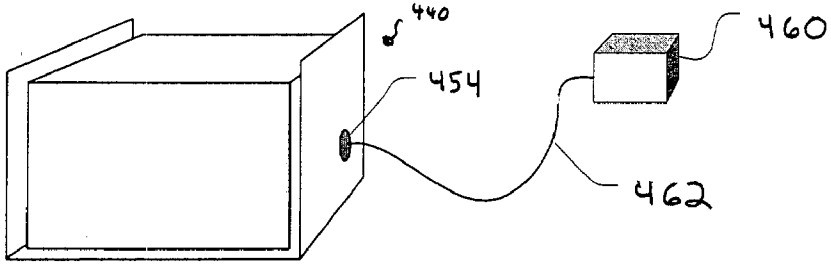
Figure 13A:
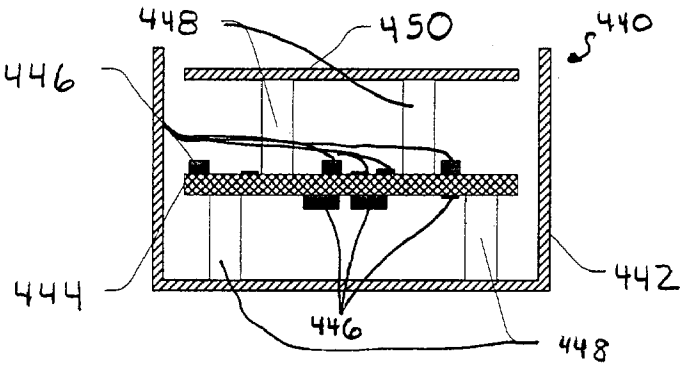
Figure 13B:
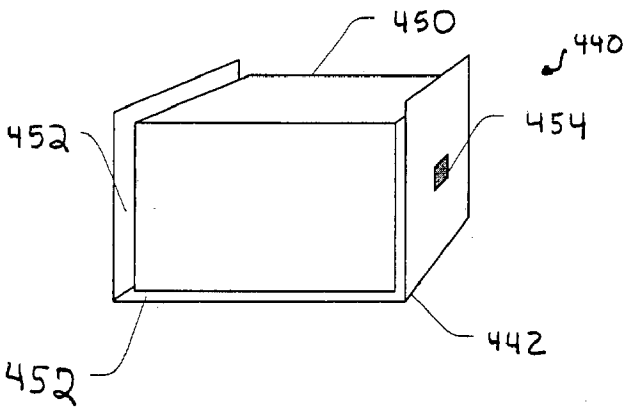

FIGS. 13A–13D illustrate a physical implementation of an ionization controller 440 in accordance with the invention. As shown in FIG. 13A, the ionizer controller 440 is comprised of a base 442 and a printed circuit board (PCB) 444 with one or more components 446 of the circuitry wherein the PCB is mounted on one or more standoffs 448 which keep the PCB separated from the base 442 and a sensor plate 450. The sensor plate is electrically connected to the PCB 444 but is insulated from the base, as seen in FIG. 13*a*. FIG. 13B further clarifies the preferred physical embodiment of the invention wherein the sensor element 450 mechanically functions as a top of the base thus lowering the cost and minimizing the parts count. As seen, the top cover, or sensor element 450, is electrically separated from the base which is grounded, by a gap 452. A connector 454 on the side of the bottom enclosure provides connection to the ionizer. If the ionizer cannot provide power, another connector (not shown) would be present to accept power from an external source.

FIG. 13*c* depicts indication LEDs 456 that are placed on the PCB 444 but protrude through the sensor plate/top cover 450 so that the LEDs provide a visual indication of the balance and decay measured by the controller. In a preferred embodiment, there is an LED bar for ionizer balance indication and separate LED bar for indication of decay (i.e. good, on limit and fail). Within the constraints of the proposed invention, the displays can be of any kind, such as numeric. Sound alarm of fail conditions may also be present if desired.

In situations where the monitoring of ionization performance needs to be done in a high-temperature environment or in other areas where it is important to have very small sensor, FIG. 13D depicts a remote sensor element 460 as a separate device connected to the ionizer controller an electrical coupling mechanism 462, such as a cable. Since the remote sensor 460 can be passive, i.e. not include any electronics components, it can be made of high-temperature materials and be placed in high-temperature environment.

Figures 14A, 14B:
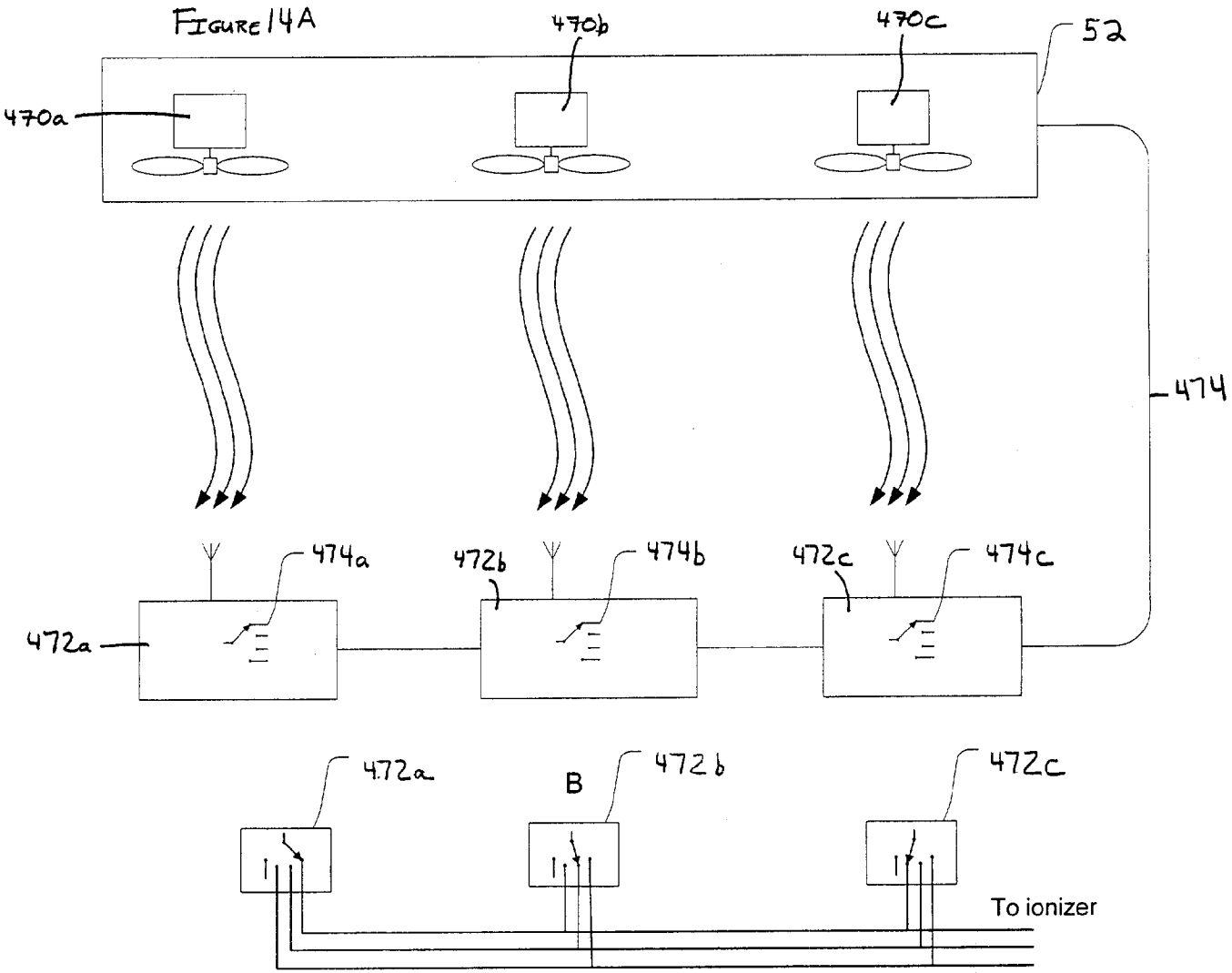
FIGS. 14A and 14B are a diagram illustrating an embodiment of a wireless ionization controller in accordance with the invention.

In ESD-critical environments, a control of each individual blower may be desirable. FIGS. 14A and 14B shows the ionizer 52 with individually-controlled blowers 470*a*, 470*b*, 470*c*. In this example, three blowers and three controllers are shown. However, the invention is not limited to any particular number of blowers or controllers. In accordance with the invention, the ionizer controllers 472*a*, 472*b*, 472*c* are positioned under each blower 470*a–c* of the ionizer to provide control of that each particular blower. In order to facilitate better electrical connection management, the ionizer controllers 472*a–c* can be connected in a chain and only a single electrical connection 174, such as a cable, would connect the last controller in the chain to the ionizer, thus minimizing number of wires. In order to associate a particular ionizer controller 472*a–c* with a particular blower 470*a–c*, a switching mechanism may be employed. As shown in FIG. 14A, the switching mechanism maybe controlled manually to set proper association (with the ID switches 474*a–c* shown in FIG. 14A) or be automatic as will be described further in this application. FIG. 14*b* shows an example of the ionizer controllers 472*a–c* being properly switched so that each ionization controller 472*a–c* has a unique identification.

Figures 15A, 15B:
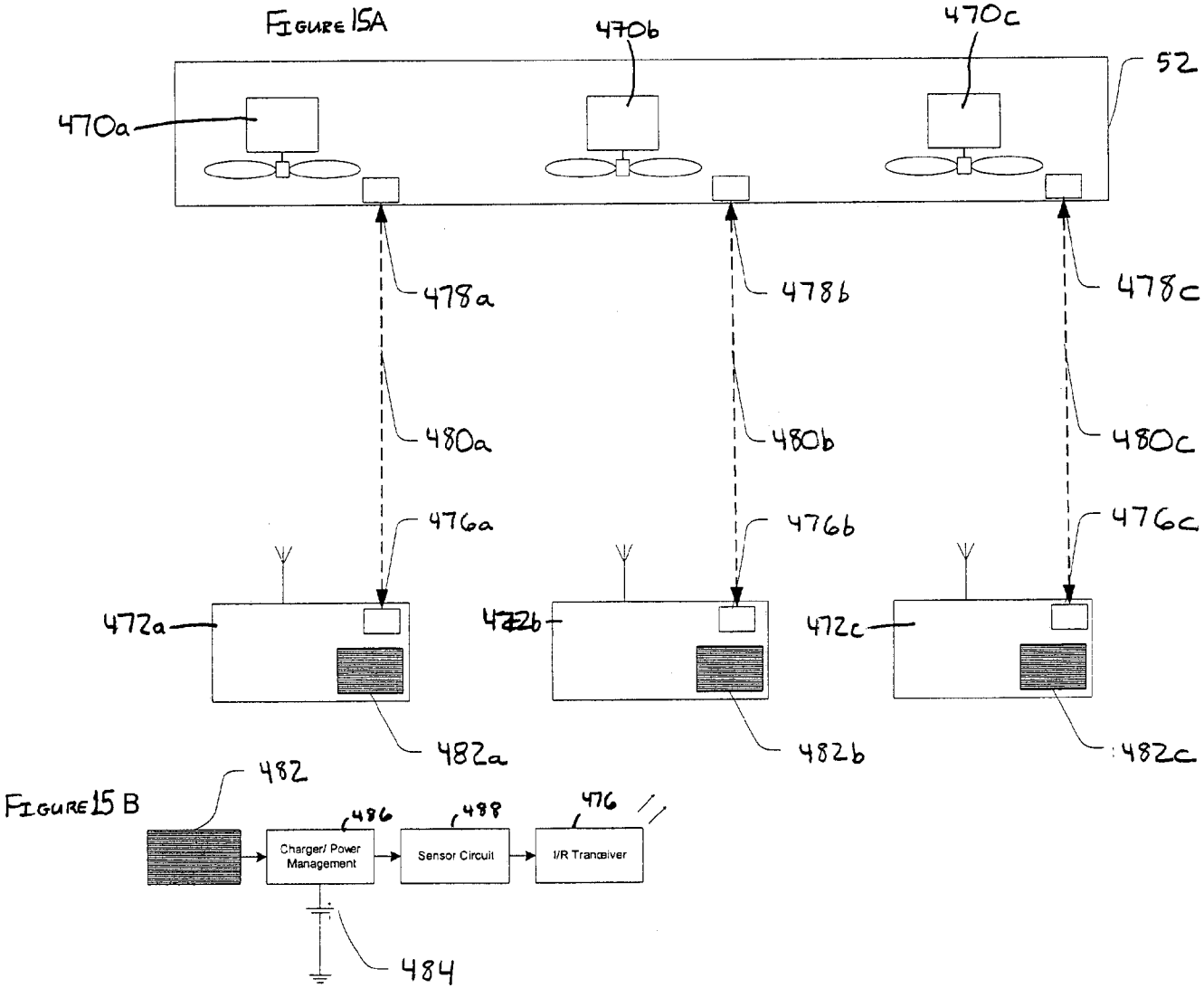
FIGS. 15A–15C are diagrams illustrating other embodiments of a wireless ionization controller in accordance with the invention.

In some cases, the physical electrical connection, such as the cable, between the ionizer controllers 472*a*–472*c* and the ionizer 52 can interfere in the manufacturing process and be undesirable. Thus, FIGS. 15A and 15B show an improvement in the connection between ionizer controller and ionizer. In the example seen in FIG. 15A, the particular ionizer has three blowers 470*a–c* that are controlled individually, but the invention is not limited to any particular number of blowers or ionization controllers. In this example shown in FIG. 14A, there are three cables between ionizer controller and ionizer would be of even more interference. To reduce such cabling, instead of a conventional wired interface, a wireless interface is used. FIG. 15*a* shows a particular example using infrared communication although the invention may be implemented with a variety of different wireless technologies, such as Bluetooth, 802.11, ultrasonic, etc. As shown, each ionizer controller 472*a–c* may include an infrared transceiver or transmitter 476*a–c* and each blower 470*a–c* may include an infrared transceiver or receiver 478*a–c* that establish a wireless communications link 480*a–c* between each ionization controller and each respective blower. In operation, the ionizer controller 472*a–c* may send infrared pulses to the ionizer with information on where to and how much to shift the balance. Since the ionizer controller must be positioned under the particular blower in order to measure its balance and/or decay, the infrared communication is greatly simplified because it is in direct line of sight. In case of multiple blower control as shown, there is no confusion over which particular sensor is controlling which blower.

Two-way communication between the ionizer 52 and ionizer controller 472*a–c* may be preferred in order for the ionizer to determine the presence and functionality of the controller so infrared transceivers can be used in each device as shown. It is further beneficial to eliminate other wires, including the ones that power each ionizer controller 472*a–c*. Taking advantage of the typically good lighting at the place of ionization, it is possible to power the ionizer controllers 472*a–c* from a photovoltaic cell 482*a–c* as shown in FIGS. 15A and B. Between communication activity, as shown in FIG. 15B, the photovoltaic cell 482 charges a rechargeable device 484, such as battery or a capacitor, in order to provide sufficient power for communication. The rechargeable device may be connected to a power management circuit/charger 486 which passes the power onto a sensor 488 and the transceiver 476.

Figure 15C:
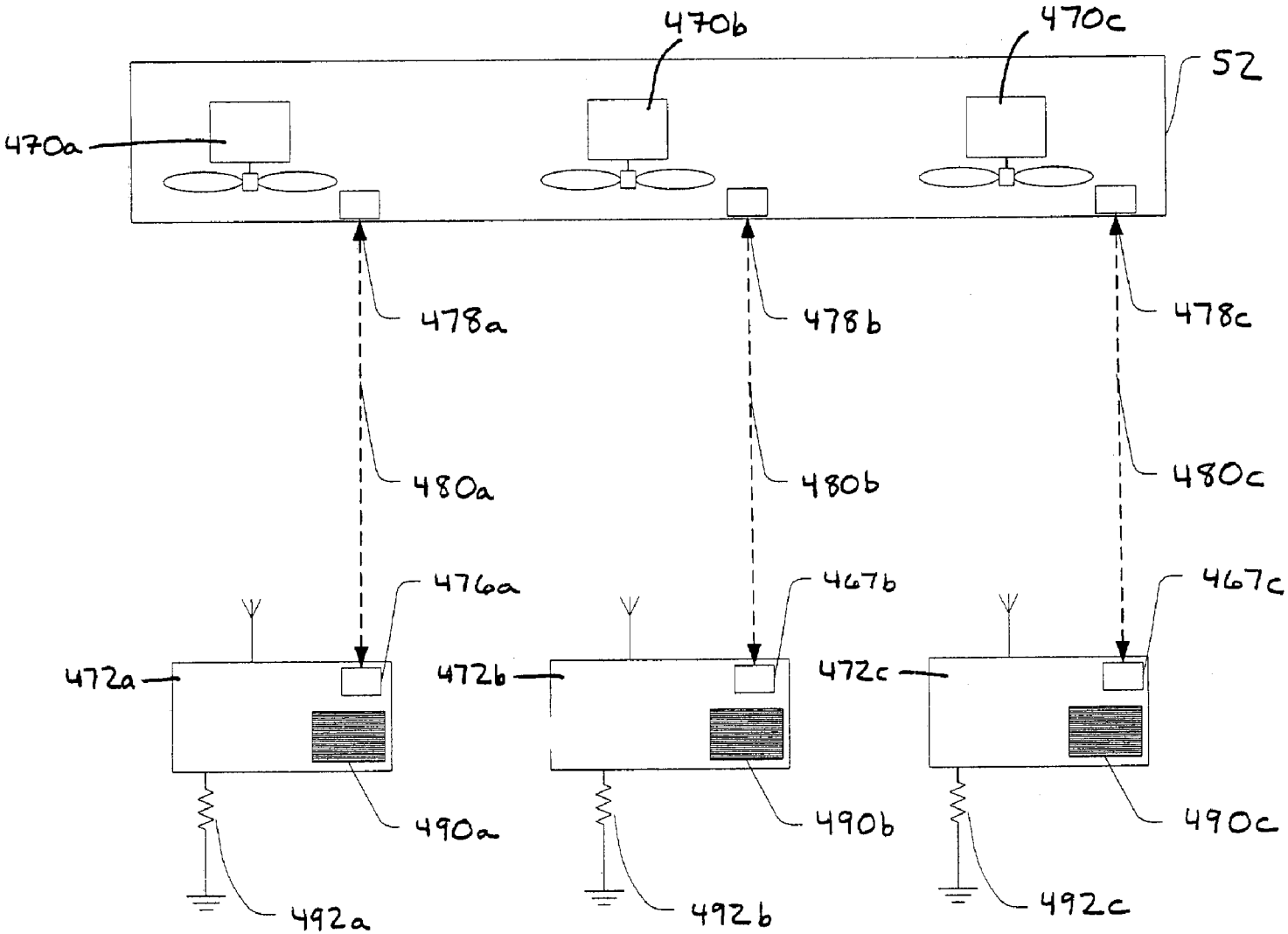

FIG. 15*c* depicts another embodiment where the ionizer controller(s) 472*a–c* are powered by an internal battery 490*a–c*. Other elements have the same reference numerals as elements in FIG. 15*b* and have the same function. As above, each ionizer controller 472*a–c* is simply placed under each blower 470*a–c* of the ionizer and would make connection to the ionizer via a wireless connection, such as infrared communication as described above. Since, in ESD-sensitive environments, the work surface is grounded either via metal connection or via static-dissipative mats, etc., the bottom part of enclosure of the ionizer controller would make electrical contact to ground 492*a–c* in order to establish ground reference.

Figure 16:
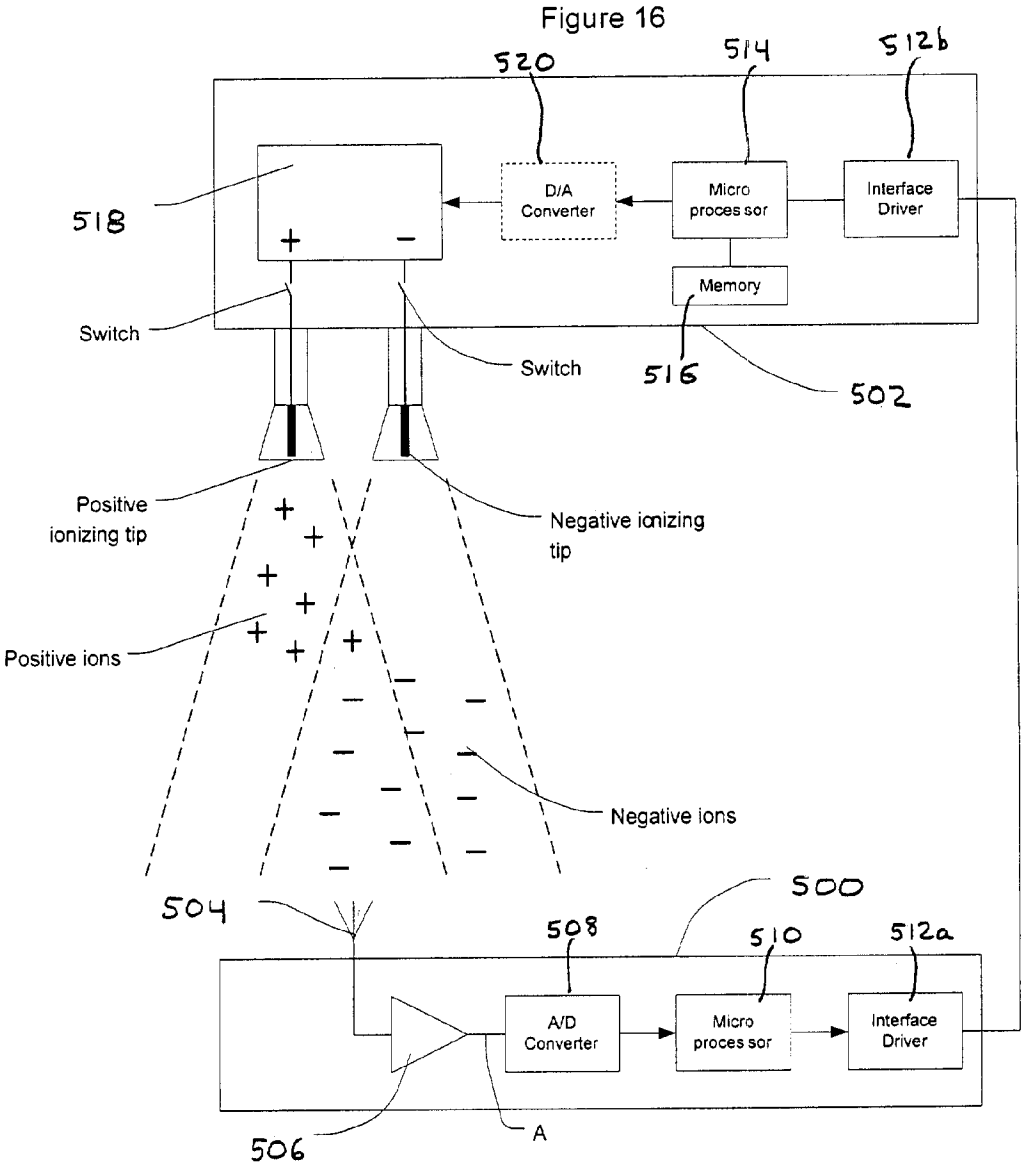
FIG. 16 is a diagram illustrating an example of a pulsed ionizer controller in accordance with the invention.
Figure 17:
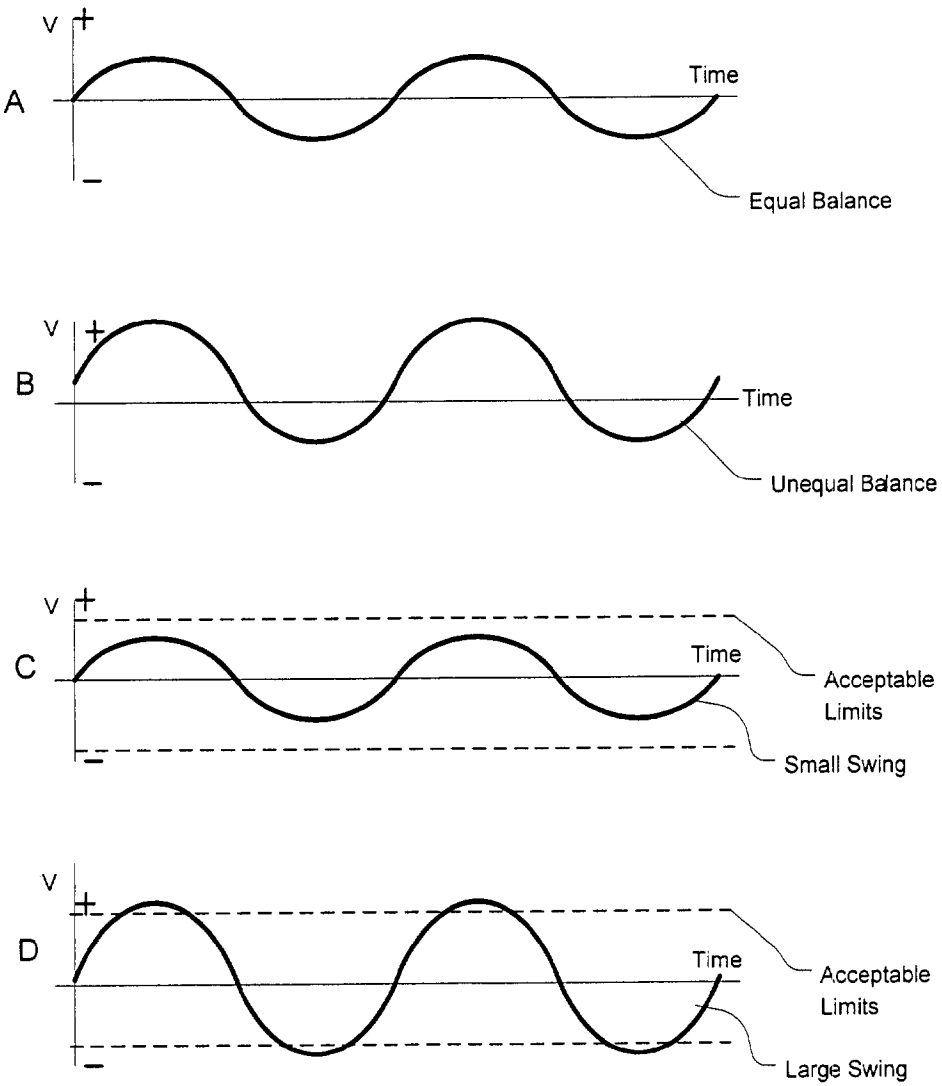
FIGS. 17A–17D are diagrams illustrating the operation of the controller of FIG. 16.

Some ionizers are pulsed ionizers that provide alternatively positive and negative high voltage pulses to the ionizer's tips. Thus, the balance at the target area is changing all the time, varying sometimes to +/−100V. There is a need to keep balance within certain limits, such as +/−50V as an example. An ionization controller 500 in accordance with the invention for a pulsed ionizer 502 is shown in FIG. 16. Similarly to the previous embodiments, a sensor 504 converts an imbalance voltage into electrical signal that is passed through a signal conditioner 506 and an A/D converter 508 to a microprocessor 510. The microprocessor 510 performs calculations to define the necessary correction factor(s) and provides the data over the interface (512*a*, 512*b*) to a microprocessor 514 of the ionizer that writes the data into a memory 516 and applies correction voltage(s) to a high-voltage power supply 518 through a D/A converter 520. FIG. 17 shows waveforms that illustrate the sensor's reaction to an imbalance and a voltage swing at point A shown in FIG. 16. As shown, if either the voltage swing or the imbalance of such swing exceeds pre-set limits, the ionization controller will provide control signal to the ionizer to bring these parameters to within requirements. Now, more details of the pulsed ionizer controller in accordance with the invention will be described.

Figures 18A, 18B:
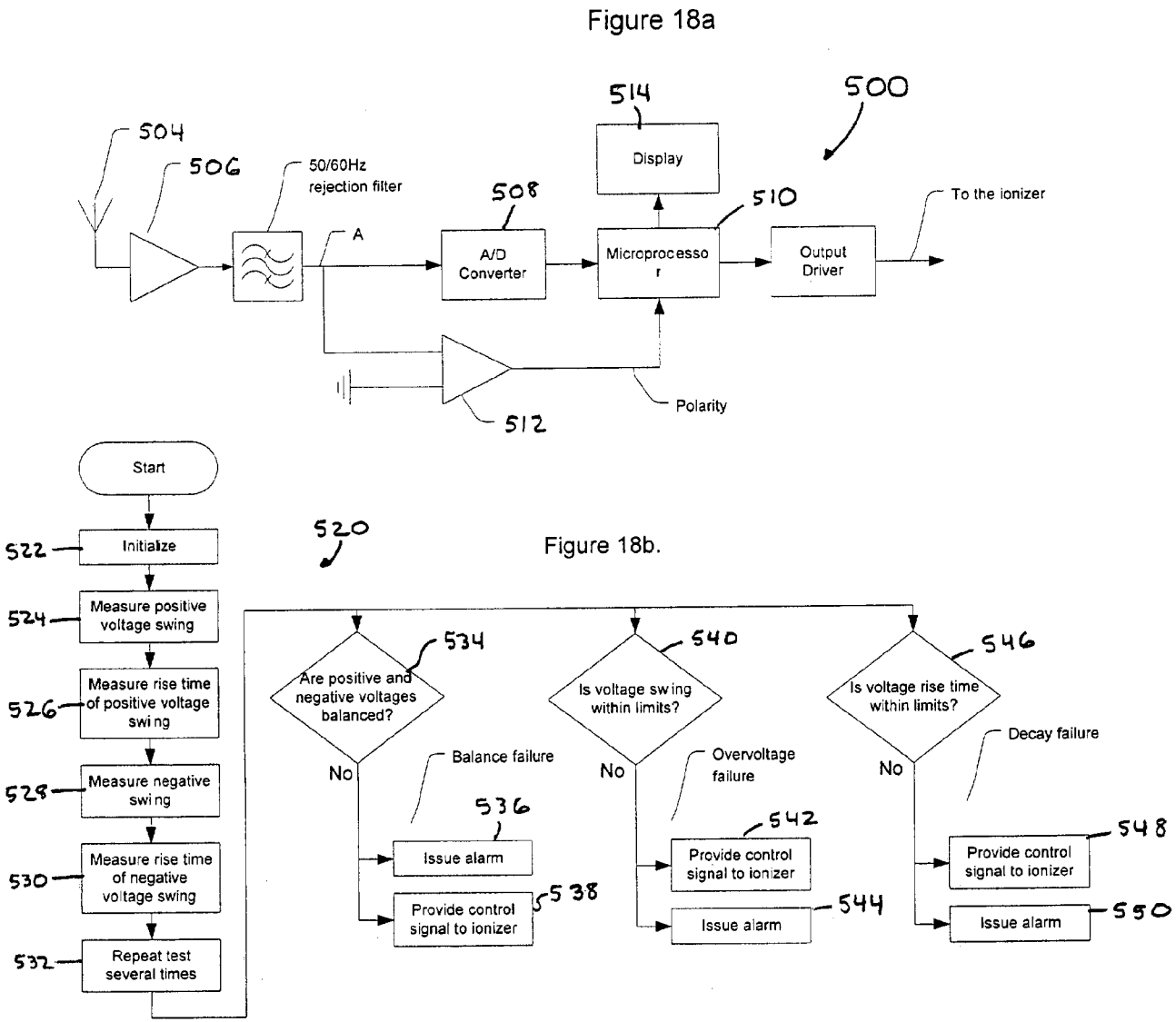
FIGS. 18A and 18B are diagrams illustrating an embodiment of the pulsed ionizer controller and its operation, respectively.

FIG. 18*a* shows functional diagram of one of the embodiments of the pulsed ionizer controller 500 in accordance with the invention. As shown, the A/D converter 508 provides measurements of the signal and a comparator 512 determines the polarity is shown for illustration purposes only because its function is easily performed by the microprocessor 510. The A/D converter 508, similarly, can be a part of the microprocessor 510. A display 514 can be of any kind, such as an LED, numeric, etc.

FIG. 18*b* shows a method 520 for controlling the pulsed ionizer in accordance with the invention. In step 522, the microprocessor is initialized. In step 524, the microprocessor measures the positive voltage swing and in step 526, the rise time of the positive voltage swing is measured. In step 528 and 530, the microprocessor measures the negative voltage swing and the rise time of the negative voltage swing, respectively. The rise time of the positive and negative voltage swings are indicative of decay of the ionization and can be used to determine decay. In step 532, the measurements above are repeated several times. Then, if any of the parameters are outside of specified limits, an alarm is issued and the appropriate control signal is sent to an ionizer. In particular, for the balance measurement, in step 534, the microprocessor determines if the positive and negative voltages are balanced, and if there is an imbalance, an alarm is issued in step 536 and a control signal is provided to the ionizer in step 538 to correct the imbalance. Similarly, for the overvoltage failure, the microprocessor determines if the voltage swings are within the limits (step 540) and, if the voltage swings are not within limits, an alarm issued (step 544) and a control signal is provided to the ionizer (step 542.) Similarly, for a decay failure, the microprocessor determines if the voltage rise times are within the limits (step 546) and, if the voltage rise times are not within limits, an alarm issued (step 550) and a control signal is provided to the ionizer (step 548.)

Figure 19:
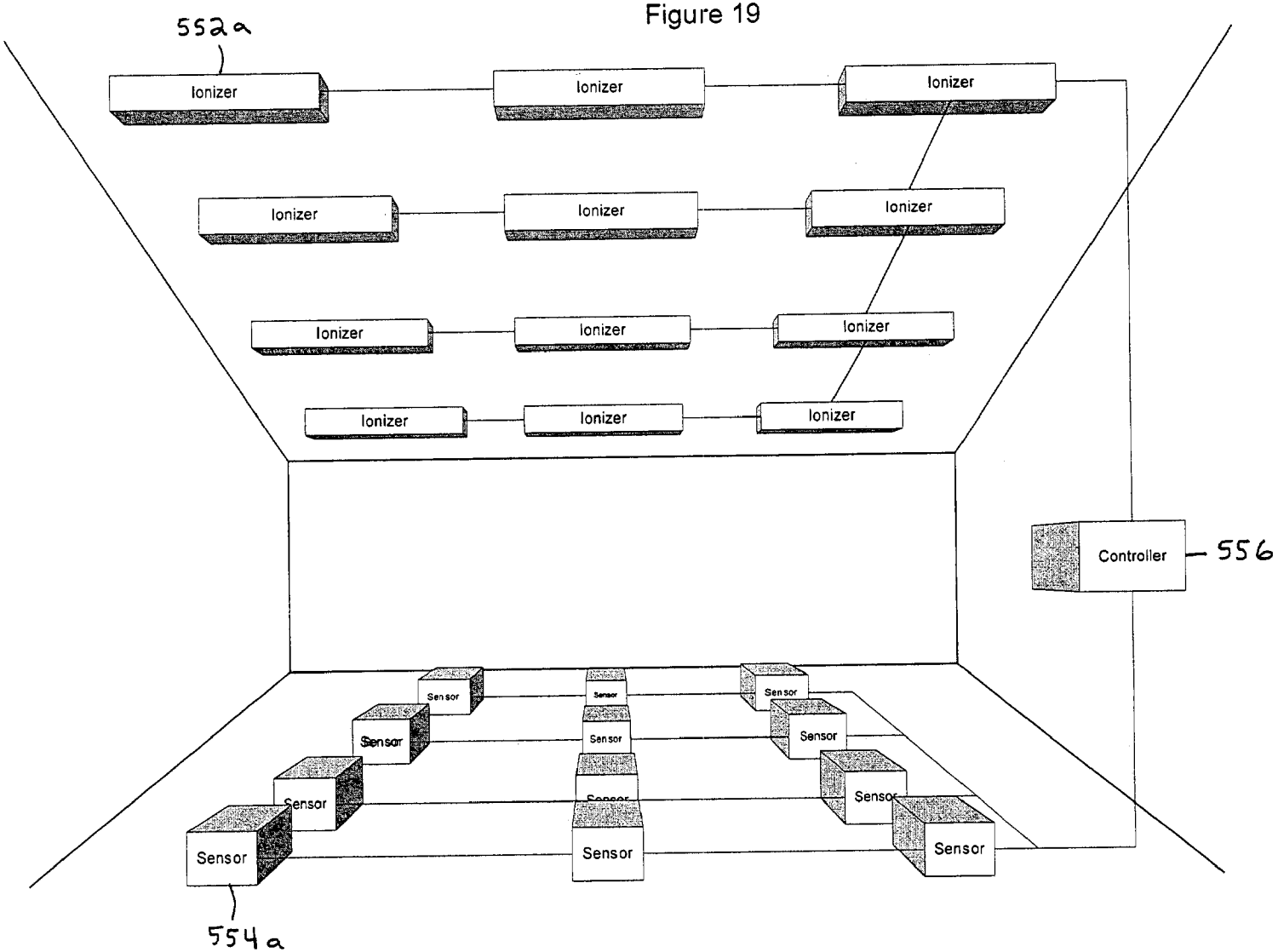
FIG. 19 is a diagram illustrating an ionization controller system in accordance with the invention that controls a plurality of ionizers.

In some cases, ionizer performance must be controlled in large installations when many ionizers 552*a* are installed on ceiling. Typically, these ionizers are connected via various types of networks between each other, the sensors 554*a* and to the controllers 556 as shown in FIG. 19. In this arrangement, it is very difficult to correlate a particular ionizer to a particular sensor.

Figure 20:
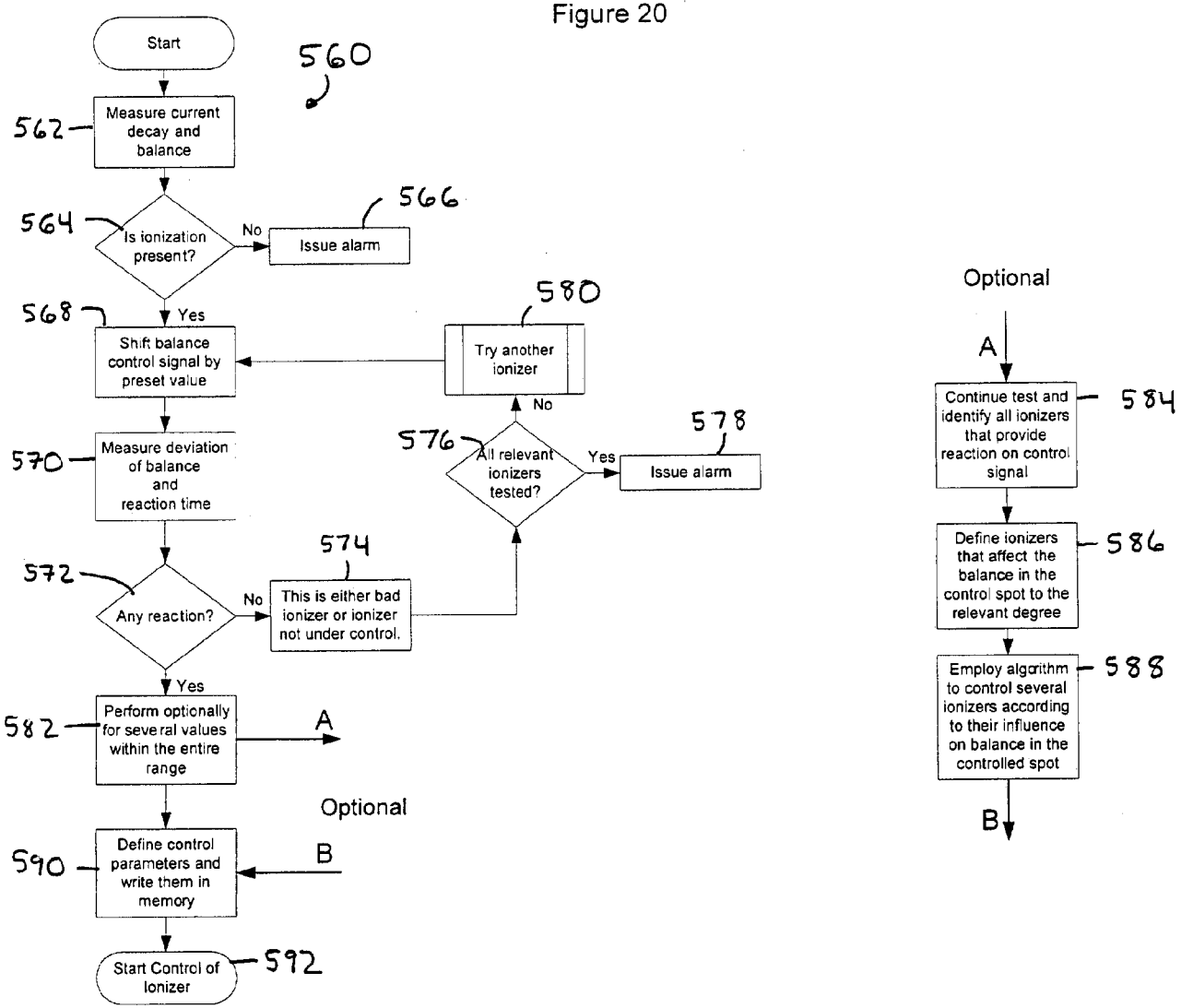
FIG. 20 is a diagram illustrating the operation of the controller of FIG. 19.

FIG. 20 is a flowchart of a method 560 for controlling a plurality of ionizers for an arrangement where a sensor positioned randomly can define which ionizer it controls and to what degree. In step 562, the current decay and balance are measured. In step 564, the microprocessor determines if ionization is present. If there is no ionization present, then an alarm is sounded in step 566. In step 568, the balance control signal is shifted by a preset value and the microprocessor measures the deviation in the balance and reaction time in step 570. In step 572, the microprocessor determines if there was any reaction. If there was no reaction, then the microprocessor determines that a bad/non-working ionizer exists or and the ionizer is not being controlled in step 574. In step 576, the microprocessor determines if all of the ionizers are tested and issues an alarm in step 578 if all of the ionizers have been tested. In step 580, if there are other ionizers to test, the microprocessor tests another ionizer and the method loops back to step 568. Returning to step 572, if there was a reaction to the shift in the control signal, then the microprocessor may optionally perform the change of control signal for several values within a range in step 582. The optional steps may include 1) continue the testing and identify all ionizers that provide reaction to the control signal (step 584); 2) define ionizers that affect the balance in the control spot to the relevant degree (step 586); and 3) employ an algorithm to control several ionizers according to their influence on the balance at the controlled spot (step 588). In step 590, the control parameters are determined and written into the memory of the microprocessor. In step 592, the control of the ionizer is started.

Figure 21:
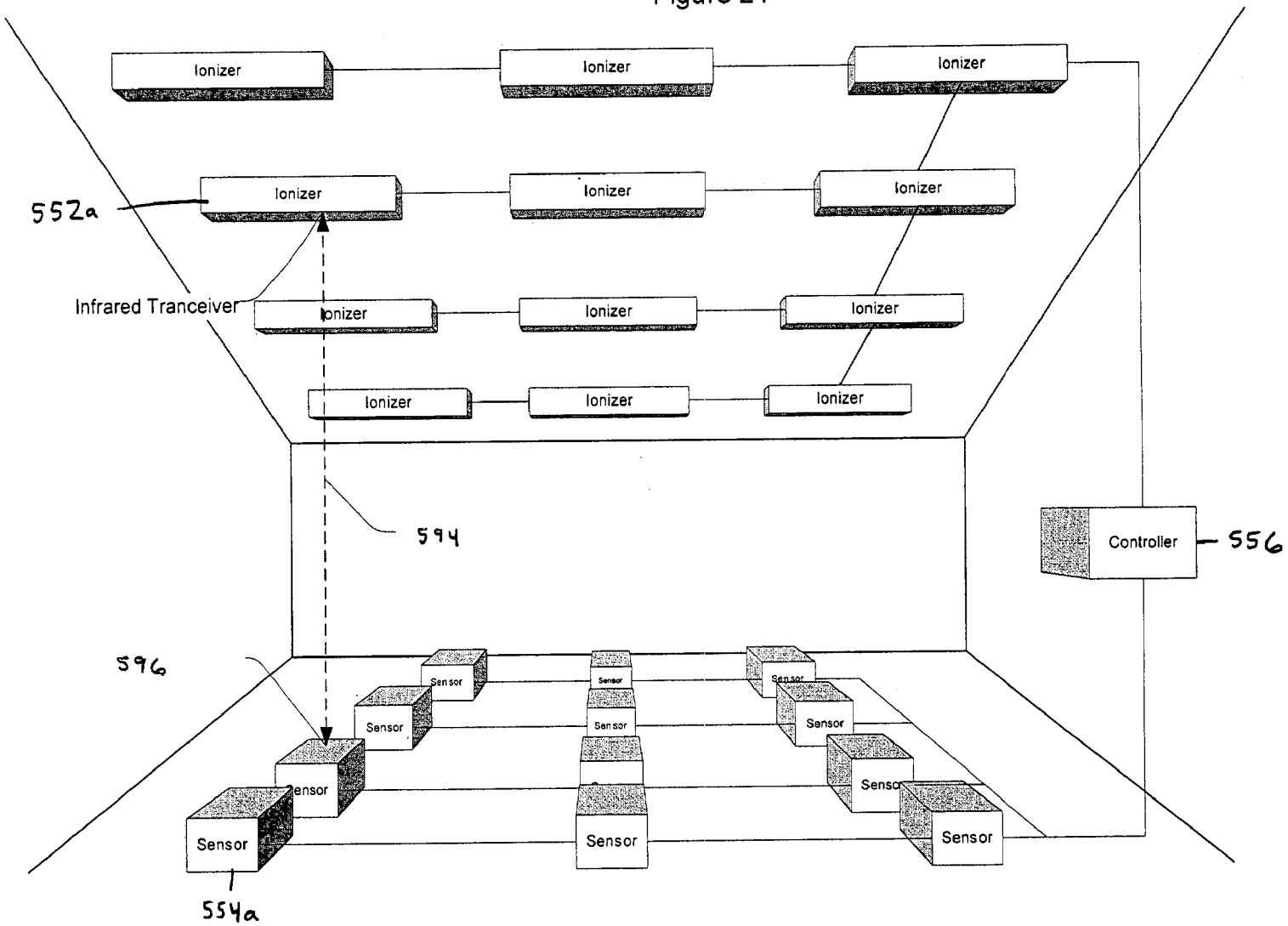
FIG. 21 is a diagram illustrating a wireless ionization controller system in accordance with the invention that controls a plurality of ionizers.

FIG. 21 shows a plurality of sensors (such as sensor 554*a* for example) communicate with a plurality of ionizers (such as ionizer 552*a* for example) using a wireless communications link 594 which utilized wireless transceivers 596 similar to the arrangement shown in FIG. 15 above. This simplifies interface with the ionizer and allows easier and faster ionizer/sensor identification.

While the foregoing has been with reference to a particular embodiment of the invention, it will be appreciated by those skilled in the art that changes in this embodiment may be made without departing from the principles and spirit of the invention as set forth in the appended claims.

What is claimed is:

1. A device for controlling ionization balance, the device comprising:

a sensor element that receives an input signal and generates a sensor signal in response to the input signal;

a control circuit that produces an ionizer control output signal as a function of the sensor signal; and a discrimination circuit, coupled to the control circuit, that disables the ionizer control output signal when a rapidly changing sensor signal is detected for the duration of the rapidly changing sensor signal.

2. The device of claim 1, wherein the discrimination circuit disables the ionizer control signal for a wait period following the detection of the rapidly changing sensor signal.

3. The device of claim 1, wherein the discrimination circuit further comprises a detector circuit, coupled to the sensor signal, that detects rapid changes in the sensor signal.

4. The device of claim 1, wherein the sensor element further comprises a current path to ground.

5. The device of claim 1 further comprising a balance circuit that is capable of adjusting the ionization balance of an associated ionizer device based on the ionizer control signal.

6. The device of claim 5, wherein the balance circuit adjusts the speed of balance adjustment as the desired level of ionization balance is approached.

7. The device of claim 5, wherein the balance circuit does not adjust the ionization balance when the balance level is in a predetermined acceptance range.

8. The device of claim 1, wherein the control circuit further comprises a processing unit, the processing unit having a learning mode wherein the processing unit is capable of learning the reaction of an ionizer being controlled and adjusting its control parameters based on the reaction time of the controlled ionizer, the control circuit further comprising a switch to place the processing unit in the learning mode.

9. The device of claim 1 further comprising an indicator that indicates the determined balance of the ionizer.

10. The device of claim 9 further comprising a switch that places the device into an observation mode for manual adjustment of the balance of the ionizer being controlled.

11. The device of claim 9, wherein the indicator generates an alarm indication if the balance is outside a predetermined range.

12. The device of claim 1 further comprising an enclosure wherein the sensor element forms a top portion of the enclosure.

13. The device of claim 1, wherein the sensor element is located at a different location than the location of the control circuit and the discrimination circuit.

14. The device of claim 1 further comprising a plurality of sensor elements wherein the sensor elements are connected to each other in a chain.

15. The device of claim 14, wherein the sensor elements are wirelessly connected to each other.

16. The device of claim 14, wherein each sensor element controls a particular ionizer and wherein the device correlates each sensor element to the ionizer that the sensor element controls.

17. The device of claim 1 further comprising a communications unit that provides communications between the device and the ionizer being controlled.

18. The device of claim 17, wherein the communications unit further comprises a wireless communications unit.

19. The device of claim 1 further comprising a photovoltaic element that provides power to the sensor element.

20. The device of claim 19 further comprising an energy storage device that stores the power necessary for communications.

21. The device of claim 1 further comprising an enclosure wherein a ground reference to the device is provided by an electrical contact between the enclosure and a conductive surface.

22. The device of claim 1 further comprising an internal battery that provides power to the device.

23. The device of claim 1, wherein the control circuit is incorporated into the ionizer being controlled.

24. The device of claim 1, wherein the control circuit further comprises a circuit that produces a signal corresponding to a positive and negative voltage value, a circuit that produces an indication of voltage swing and a circuit that produces an indication of a voltage rise time.

25. The device of claim 1 further comprising a circuit that determines a particular ionizer being controlled by the device.

26. A method for controlling ionization balance, comprising:

generating a sensor signal in response to a received input signal;

producing an ionizer control output signal as a function of the sensor signal; and disabling the ionizer control output signal when a rapidly changing sensor signal is detected for the duration of the rapidly changing sensor signal.

27. The method of claim 26 further comprising disabling the ionizer control signal for a wait period following the detection of the rapidly changing sensor signal.

28. The method of claim 26 further comprising adjusting the ionization balance of an associated ionizer device based on the ionizer control signal.

29. The method of claim 28, wherein the adjusting further comprises adjusting the speed of the balance adjustment as the desired level of ionization balance is approached.

30. The method of claim 28 further comprises disabling the adjustment when the balance level is in a predetermined acceptance range.

31. The method of claim 26 further comprising a learning mode wherein a processing unit is capable of learning the reaction of an ionizer being controlled and adjusting its control parameters based on the reaction time of the controlled ionizer.

32. The method of claim 26 further comprising indicating the determined balance of the ionizer.

* * * * *